US005778334A

United States Patent [19]

Ozawa et al.

[11] Patent Number: 5,778,334

[45] Date of Patent: Jul. 7, 1998

[54] SPEECH CODERS WITH SPEECH-MODE DEPENDENT PITCH LAG CODE ALLOCATION PATTERNS MINIMIZING PITCH PREDICTIVE DISTORTION

[75] Inventors: Kazunori Ozawa; Masahiro Serizawa, both of Tokyo, Japan

[73] Assignee: NEC Corporation, Tokyo, Japan

[21] Appl. No.: 510,217

[22] Filed: Aug. 2, 1995

[30] Foreign Application Priority Data

| | | | |
|---|---|---|---|
| Aug. 2, 1994 | [JP] | Japan | 6-198950 |
| Sep. 8, 1994 | [JP] | Japan | 6-214838 |
| Jan. 5, 1995 | [JP] | Japan | 7-000300 |

[51] Int. Cl.[6] ..... G10L 9/14

[52] U.S. Cl. ..... 704/219; 704/214; 704/223; 704/229

[58] Field of Search ..... 395/2.23, 2.25, 395/2.3, 2.31, 2.32, 2.28, 2.38

[56] References Cited

U.S. PATENT DOCUMENTS 5,253,269 10/1993 Gerson et al. ..... 375/247

FOREIGN PATENT DOCUMENTS

| | | |
|---|---|---|
| 4-171500 | 6/1992 | Japan . |
| 4-363000 | 12/1992 | Japan . |
| 5-6199 | 1/1993 | Japan . |
| 6-222797 | 8/1994 | Japan . |

OTHER PUBLICATIONS

Schroeder, "Code-Excited Linear Prediction (CELP): High-Quality Speech At Very Low Bit Rates", *Proc. ICASSP*, pp. 937–940, (1985).

Kleijn et al., "Improved Speech Quality And Efficient Vector Quantization In SELP", *Proc. ICASSP*, pp. 155–158, (1988).

Gerson et al., "Techniques For Improving The Performance of CELP-Type Speech Coders", *IEEE J. Sel. Areas in Commun.*, pp. 858–865, (1992).

Trancoso et al., "Efficient Procedures For Finding The Optimum Innovation In Stochastic Coders", *IEEE Proc. ICASSP-86*, pp. 2375–2378, (1986).

Nakamizo, "Signal Analysis And System Identification", *Corona Publishing Co.*, pp. 82–87, (1988).

Sugamura et al., "Speech Data Compression By Linear Spectral Pair (LSP) Speech Analysis-Synthesis Method", *Journal of the Electronic Communication Institute*, J64-A, pp. 599–606, (1981).

Taniguchi et al., "Improved CELP Speech Coding At 4 KBIT/S And Below", *Proc ICSLP*, pp. 41–44, (1992).

Kroon et al., "Pitch Predictors With High Temporal Resolution", *Proc. ICASLP*, pp. 6611–664, (1990).

Nomura et al., "LSP Coding Using VQ-SVQ With Interpolation In 4-075 KBPS M-LCELP Speech Coder", *IEEE Proc. Mobile Multimedia Communications*, pp. B.2.5-1–B.2.5-4, (1993).

*Primary Examiner*—Allen R. MacDonald
*Assistant Examiner*—Tālivaldis Ivars Šmits
*Attorney, Agent, or Firm*—Foley & Lardner

[57] ABSTRACT

A speech coding device capable of delivering a speech signal of excellent sound quality at a low bit rate is disclosed. The disclosed device is characterized by a method of calculating lag corresponding to pitch period and a speech signal coding method. Lag is calculated as follows: A speech signal is divided into frames; one frame is divided into a plurality of subframes; for each frame, subframes in which lag of a speech signal is expressed in the form of a differential relative to lag of a previous subframe and subframes in which lag is expressed in the form of an absolute value, i.e., the lag value itself, are established; a plurality of bit allocation patterns are established for each frame that allocate bits for expressing lag as an absolute value or a differential in each of the plurality of subframes; for each bit allocation pattern, pitch predictive distortion is calculated for every subframe; accumulated distortion is calculated by accumulating the pitch predictive distortion over a predetermined plurality of subframes in the frame; a bit allocation pattern is selected so as to minimize the accumulated distortion. The lags in the subframes of the selected pattern are determined as the lags in the subframes of interest.

25 Claims, 15 Drawing Sheets

10
501
502
503
v (n)
x' w (n)
h w (n)
110
LAG CAL. CCT.
T
β
120
LAG PREDICTOR
Th
eq
130
DIFFERENTIAL QUANTIZ. SECT.
eh q
140
SUBFRAME LAG SECT.
125
PREDICTIVE COEFF. CODEBOOK
150
LAG REPRODUCT. SECT
T'
160
PITCH PREDICTOR
z(n)
504
505

10
501
502
503
v (n)
x'w (n)
hw (n)
110
LAG CAL. CCT.
T
120
LAG PREDICTOR
β
Th
130
DIFFERENTIAL QUANTIZ. SECT.
eq
ehq
170
DISCRIM SECT.
140
SUBFRAME LAG SECT.
125
PREDICTIVE COEFF. CODEBOOK
150
LAG REPRODUCT. SECT
T'
180₁
180₂
160
PITCH PREDICTOR
z(n)
504
505
506

10
501
502
503
801
v(n)
x'w(n)
h w(n)
MODE
110
LAG CAL. CCT.
T
120
LAG PREDICTOR
Th
β
130
DIFFERENTIAL QUANTIZ. SECT.
eq
eh q
150
LAG REPRODUCT. SECT
T'
180₁
180₂
140
SUBFRAME LAG SECT.
125
PREDICTIVE COEFF. CODEBOOK
160
PITCH PREDICTOR
z(n)
504
505

10
501
502
503
901
v (n)
x'w (n)
hw (n)
MODE
110
LAG CAL. CCT.
T
120
LAG PREDICTOR
β
Th
130
DIFFERENTIAL QUANTIZ. SECT.
eq
enq
170
DISCRIM SECT.
140
SUBFRAME LAG SECT.
125
PREDICTIVE COEFF. CODEBOOK
150
LAG REPRODUCT. SECT
T'
180₁
180₂
160
PITCH PREDICTOR
z(n)
504
505
506

SPEECH CODERS WITH SPEECH-MODE DEPENDENT PITCH LAG CODE ALLOCATION PATTERNS MINIMIZING PITCH PREDICTIVE DISTORTION

BACKGROUND OF THE INVENTION

1. Field of the Invention

The present invention relates to a speech coding method and associated device for high-quality encoding of a speech signal at a low bit rate, particularly at bit rates below 4.8 kbits/sec.

2. Description of the Related Art

Code Excited LPC Coding (CELP) is one known method of coding a speech signal at a low bit rate of below 4.8 kbits/sec and is described in, for example, the papers entitled "Code-excited linear prediction: High quality speech at low bit rates," by M. Schroeder and B. A. Atal (Proc. ICASSP, pp. 937–940, 1985), and "Improved speech quality and efficient vector quantization in SELP" by Kleijn et al. (Proc. ICASSP, pp. 155–158, 1988).

According to this method, a spectral parameter indicating a spectral characteristic of a speech signal is extracted, on the sending side, every frame (for example, 20 ms) of the speech signal using linear predictive coding (LPC) analysis. The frames are further divided into subframes (for example, 5 ms), and parameters (lag parameter and gain parameter) stored in an adaptive codebook are selected every subframe based on a previous excitation signal. Pitch prediction of the speech signal is carried out in each subframe by an adaptive codebook circuit, and for a residual error obtained in the pitch prediction, an optimal excitation codevector is selected from a excitation codebook (vector quantization codebook) composed of noise signals of predetermined types, and optimal gain is calculated.

The selection of an excitation codevector is carried out so as to minimize the error power of this residual error for a signal synthesized from the selected noise signal. Gain and an index indicating the selected codevector type are multiplexed together with the spectral parameter and the adaptive codebook parameter by multiplexer and transmitted to the receiving side.

At the decoding device on the receiving side, a speech signal is synthesized based on the gain and index of the codevector, the spectral parameter, and other transmission codes sent from the coding device on the sending side. Since the decoding device does not directly relate to the present invention, explanation of its construction will therefore be omitted.

In the prior art methods described in Schroeder et al. and Kleijn et al., there has been the problem that tone quality for a female voice is drastically degraded when a bit number allotted to the excitation codebook is decreased in order to decrease the bit rate.

One known method of overcoming this problem involves decreasing the bit number for expressing a lag of the adaptive codebook by representing the lag for the adaptive codebook with a differential while restraining a decrease in a bit number of the excitation codebook to a minimum.

In differential expression, the differential between the lag of an immediately preceding subframe and the lag of the current subframe is represented by a predetermined low number of bits. For example, if the frame length is 40 ms and the subframe length is 8 ms, and if the lag of the first subframe is expressed in 8 bits and the lags of the second through fifth subframes are expressed in 5 bits in terms of the differential relative to the immediately preceding subframe, then the entire frame is expressed in 28 bits.

By this method, a 30% reduction of bits can be achieved compared to the 40 bits per frame required by the prior art method in which 8 bits are allocated to each subframe. Regarding details of the differential coding of lag, reference may be made to, for example, "Techniques for improving the performance of CELP-type speech coders" by Gerson et al. (IEEE J. Sel. Areas in Commun., pp. 858–865, 1992).

Since the time correlation of the lags in subframes is strong for a steady vowel region, there may be little degradation in a sound quality through differential expression when the method described in Gerson et al. is employed for the vowel region. However, the differential expression does not provides satisfactory representation of a time variation of pitch at a sound part having relatively a rapid change in speech pitch period such as in a speech transient region or in a vowel if it includes a transition region of phonemes, thus entailing the problem of degradation of the sound quality of reproduced speech due to unclear sound reproduction and introduction of noise.

Furthermore, as the bit rate decreases, this problem becomes particularly conspicuous for a female speaker or a speaker whose pitch varies widely over time.

SUMMARY OF THE INVENTION

1. OBJECT OF THE INVENTION

The first object of the present invention is to solve the above-described problem by proposing a speech coding device by which satisfactory sound quality can be obtained with relatively few operations and little memory and even at low bit rate of, for example, 4.8 kbits/sec.

In the above-described methods of the prior art, lag parameters have been calculated for individual subframes by an adaptive codebook circuit and the calculated lag parameters have been transmitted independently. For example, lag is within a range of 16–140 samples for a voice, and in order to achieve sufficient accuracy for, for example, a female voice having short pitch period, lag must be sampled not at integer multiples, but at decimal multiples of a sampling period. Consequently, a minimum of 8 bits per subframe is required to represent a lag, meaning that 32 bits are necessary provided that one frame contains four subframes. If frame length is 40 ms, then the transmission amount per second is 1.6 kbits/sec.

As a result, when attempting to send a satisfactory speech signal at below 4 kbits/sec, the amount of the information necessary for transmitting lag must have been reduced. However, if the bits allotted per subframe are merely decreased in number, such decrease will cause narrowing of the range of pitch change and insufficient accuracy of the synthesized voice, thereby causing sound quality to deteriorate sharply.

The second object of the present invention is to provide a speech coding method and device that solve the above-described problems and enable transmission of lag with fewer bits.

In the above-described speech coding method of the prior art, when the CELP method is used to encode a speech signal at a low bit rate, an extensive operation is necessary to search for an excitation codevector $c_j$ that minimizes the value of $D_j$ in the following equation (1):

$$D_j=\Sigma[z(n)-\gamma_j c_j(n)*h(n)]^2 \quad (1)$$

Here, as will be explained hereinbelow, z(n) is an adaptive codebook predictive residual error, $c_j(n)$ is the $j^{th}$ excitation codevector in the excitation codebook, and $\gamma_j$ and h(n) are the ideal gain for the $j^{th}$ excitation codevector $c_j$ and an impulse response obtained from spectral parameters, respectively. Σ is the sum from n=0 to n=N−1, where N denotes the length of a subframe. Here, the spectral noise weighting operation to be explained hereinbelow has been omitted for the sake of simplification.

The excitation codevector that minimizes equation (1) can be obtained through the equivalent relation of making the following equation a minimum:

$$D_j = \Sigma z(n)^2 - (CC_j^2/R_j^2) \quad (2)$$

Here, $$CC_j^2 = \{\Sigma z(n)\,[c_j(n)*h(n)]\}^2 \quad (3)$$

$$R_j^2 = \Sigma[c_j(n)*h(n)]^2 \quad (4)$$

The symbol * represents a convolution operation, and Σ again stands for the sum from n=0 through N−1.

In this prior art speech coding method, the amount of calculations is particular extensive for equation (4). For example, if the degree of h(n) is 20 points and N=64, then a total of 20×64+64=1344 sum-of-product operations is required per excitation codevector. If this value is converted into a per second basis, a total of 1344×8000/64=168,000 operations is necessary. For this reason, reduction of the number of operations is required to allow coding at higher speeds.

As a method of reducing the number of operations required for searching the excitation codebook, a method has been proposed in which equation (4) is approximated by equation (5) below:

$$R_j^2 \approx \mu_j(0)\nu(0) + 2\Sigma^L \mu_j(i)\nu(i) \quad (5)$$

Here, $\Sigma^L$ is the sum from i=1 to i=L, and L≦N, normally L<N, wherein $$\mu_j(i) = \Sigma^{N-1-i} c_j(n)c_j(n+1) \quad (6)$$

$$\nu(i) = \Sigma^{N-1-i} h(n)h(n+i) \quad (7)$$

Here, $\Sigma^{N-1-i}$ represents the sum from n=0 to n=N−1−i.

This method is called the auto-correlation method. In this method, the calculation of equation (6) can be carried out for each excitation codevector beforehand with the calculated results stored in a memory. Consequently, the amount of operation is zero. The calculation of equation (7) need be carried out only once before searching the excitation codebook, and thus the calculation of equation (5) requires substantially L sum-of-product operations per excitation codevector. For example, if L=20, then the number of sums of products is drastically reduced to only 1/67 that for the above-described prior art method. Details of the auto-correlation method are here omitted but may be found by referring to, for example, "Efficient procedures for finding the optimum innovation" by Trancoso et al. (IEEE Proc. ICASSP-86, 1986, pp. 2375–2378).

In the method described in Trancoso et al., however, the problem has been that, because the value of $R_j^2$ is only approximated by equation (5), an approximation error is generated. Furthermore, since this approximation error depends on the rate of decay of impulse response h(n) and the form of codevector $c_j(n)$, this error becomes notable when the value of L in equation (5) is set to a small number, particularly in the case that the impulse response length is long such as for a vowel portion. Consequently, there is the problem that the application of equation (5) can cause deterioration of speech reproduction because the calculation result of equation (5) does not always cause the selection of the excitation codevector that makes equation (2) a minimum.

The third object of the present invention is to provide a speech coding method and device that solves the above-described problem and enables speech coding of satisfactory sound quality at a bit rate of 4.8 kbits/sec or less with relatively few operations and a small memory capacity.

2. OVERVIEW OF THE INVENTION

To achieve the above-described first object, the first speech coding device of the present invention comprises:

- frame splitter section that receives an incoming speech signal, divides said speech signal into frames of a predetermined time length, and splits the speech signal of each of said frames into a plurality of subframes;
- spectral parameter calculator section that calculates spectral parameters that represent a spectral characteristic of said speech signal;
- spectral parameter quantizer section that quantizes the spectral parameter for each subframe using a quantization codebook;
- impulse response calculator section that receives outputs of said spectral parameter calculator section and outputs of said spectral parameter quantizer section and calculates impulse responses of a spectral noise weighting filter;
- spectral noise weighting section for executing spectral noise weighting of said speech signal according to the spectral parameter supplied from said spectral parameter calculator section to generate a spectrally weighted speech signal;
- adaptive codebook section that receives a spectrally weighted speech signal, said impulse response, and a previous excited speech sound source signal calculated by a known method, calculates a lag corresponding to a pitch period of the speech signal every subframe, and outputs both the calculated result and an adaptive codebook predictive residual signal;
- excitation quantizer section that selects an optimum excitation codevector from an excitation codebook such that error power between said adaptive codebook predictive residual signal and a speech signal synthesized from the excitation codevector selected from the excitation codebook minimizes;
- gain quantizer section that selects an optimum gain codevector such that error power between said adaptive codebook predictive residual signal and a speech signal synthesized from both said optimum excitation codevector and a gain codevector selected from the gain codebook minimizes;
- multiplexer section for multiplexing the parameters extracted from said spectral parameter calculator section and from said adaptive codebook section, and indexes indicating the optimum excitation codevector and the optimum gain codevector; and
- pattern storage section for storing at least one type of bit number allocation pattern that, for every frame, describes locations, within that frame, of subframes for which lags are to be represented by differentials and also describes numbers of bits allocated to the subframes for representing the lags;

said adaptive codebook section (a) reading the bit number allocation pattern from the pattern storage section;

(b) setting lag search ranges based on a number of bits allocated for each subframe;

(c) calculating pitch prediction distortion for a plurality of lag values within said lag search range for each subframe, extracting at least one pitch prediction distortion in order from the smallest pitch prediction distortion, and searching the lag codebook for the lag corresponding to the at least one extracted pitch prediction distortion for each of the subframes;

(d) calculating accumulated distortion, which is an accumulation of said pitch prediction distortion over a predetermined plurality of the subframes within the frame of concern;

(e) repeating processes (b) through (d) above for each of the bit number allocation patterns;

(f) selecting a bit number allocation pattern which minimizes the accumulated distortion and determining a lag of the speech signal for each subframe of that selected pattern as a lag of the speech signal in each of the subframes;

(g) calculating lag by section of a closed loop search using the lags calculated in process (f) as lag candidates, and (h) generating an adaptive codebook predictive residual signal which is the difference between said weighted signal and a weighted signal synthesized from a previous excited speech sound source signal.

The adaptive codebook section operates as follows:

The M different bit number allocation patterns (hereinafter referred to as "patterns") which indicate the number of bits representing lags in subframes within a frame are first prepared. For the sake of simplicity, the explanation is based on the case where M=2.

Let the patterns be (8, 5, 8, 5, 5) and (8, 5, 5, 8, 5). Here, 5-bit subframes represent lags by differentials (differential representation), and 8-bit subframes indicate lag not by differentials but by absolute values, i.e., the lag values itself (absolute representation).

Accordingly, in the first pattern (8, 5, 8, 5, 5) of the example above, the lags of the second, fourth, and fifth subframes are represented by differentials, while in the second pattern (8, 5, 5, 8, 5), the lags of the second, third and fifth subframes are indicated by differentials. One frame (40 ms) is composed of five subframes (8 ms).

The adaptive codebook section first selects L ($L \geqq 1$) different lags for each subframe of the frame of concern by a preliminary selection in accordance with open-loop and closed-loop methods so that the pitch prediction distortion $G_j$ in equation (8) below is minimized:

$$G_j=\Sigma x_{w,j}(n)^2-[[\Sigma x_{w,j}(n)x_{w,j}(n-T)]^2/[\Sigma x_{w,j}(n-T)^2]] \quad (8)$$

In the above equation (8), Σ stands for the sum from n=1 through n=N−1, $x_w(n)$ represents a spectrally weighted speech signal, T represents the lag, and j indicates the subframe number.

The closed loop selection of a lag in the adaptive codebook section refers to the selection of one or more candidates of a lag in the order such that the error power between a speech signal and synthesized speech signal is minimized, wherein the synthesized speech signal is produced by filter-processing of a previous excitation signal. The selection of a lag by open loop processing, on the other hand, is performed by using a previous speech signal, and involves fewer operations because filtering is not required in the search.

When the lag is searched, a lag search range is established for each subframe based on the allocated number of bits.

Let the lag search range for a subframe of the absolute representation be $(T_1, T_2)$, in which $T_1$, $T_2$ are the lower and upper limits of the range, respectively. Then the lag T is searched in the range of $T_1 \leqq T < T_2$ so that equation (8) is minimized. Suppose that $T_1=20$, $T_2=147$ and the lag is represented in increments of ½, then the lag search range includes 256 different lag values which can be indicated by 8-bit codes.

The lag search range $(T_3, T_4)$ for a subframe of the differential representation is taken narrower, $T_1 < T_3 \leqq T < T_4 < T_2$. The numerical values of $T_3$ and $T_4$ are determined on the basis of the bit number allocated to the subframes of the differential representation (5 bits in the above example).

Reference can be made to Gerson et al. above for a description of an actual method of differential representation.

The searches for lags T which minimize the pitch prediction distortion $G_j$ in equation (8) are performed for all subframes within a frame, and using the results, the accumulated distortion G is calculated by accumulating the pitch prediction distortions $G_j$ over a plurality of subframes as shown in equation (9) below.

$$G=\Sigma G_j \quad (9)$$

In the above equation, Σ denotes the sum from j=1 through j=S and S is the number of subframes for which distortion is accumulated. For example, the value of S may be the number of all subframes in a frame.

The above-described processes are repeated for the combinations of the L different lag candidates found in every subframe, and one combination of the lags is selected so that the accumulated distortion G (equation (9) above) is minimized.

Furthermore, the above processes are repeated for each of the two patterns, and the pattern having less accumulated distortion is selected.

According to the first coding device of the present invention, when calculating lag in the adaptive codebook section, the lag is represented by differentials in at least one subframe within the frame, and at least either bit numbers for representing lags or the positions of the subframes employing the differential representation, are set up for every frame, and consequently, less information need be transmitted from the adaptive codebook section than in the systems of the prior art. As a result, not only can the bit rate be reduced, but speech reproduction can be provided with little degradation despite time variations of the lag corresponding to pitch period at speech transient regions.

As a modification of the above-described first speech coding device of the present invention, a mode classification section can be provided in place of the pattern storage section. The mode classification section receives the output of the frame splitter section, calculates a characteristic quantity from the speech signal in each frame, and classifies the speech signal for each frame into one of a plurality of predetermined speech modes in accordance with the characteristic quantity. The calculation of equation (9) is repeated for the bit number allocation patterns belonging to that speech mode, and the bit number allocation pattern which minimizes the accumulated distortion is selected.

The operation of this modification will be explained in the case having four modes. In this case, $G_j$ in equation (8), which is the open-loop pitch prediction distortion found in each subframe, is accumulated by means of equation (9) to give the accumulated distortion, which is taken as the characteristic quantity. The value of S in (9) above is 5. The mode of the speech signal is determined by comparing the value of the accumulated distortion G with three predetermined reference values $TH_1$~$TH_3$. The determination of mode may be as follows:

| | |
|---|---|
| When $G > TH_1$, | mode 0 |
| When $TH_2 < G \leqq TH_1$, | mode 1 |
| When $TH_3 < G \leqq TH_2$, | mode 2 |
| When $G \leqq TH_3$, | mode 3 |

In other words, provided that $TH_3<TH_2<TH_1$, mode 0 is selected when the value of accumulated distortion G is larger than reference value $TH_1$, mode 1 is selected when G is larger than $TH_2$ but less than or equal to $TH_1$, mode 2 is selected when G is larger than $TH_3$ but less than or equal to $TH_2$, and mode 3 is selected when G is less than or equal to $TH_3$.

Next, the numbers of bits for representing the lags and the positions of subframes in which lags are represented by differentials are determined according to the mode in the adaptive codebook section, i.e., the bit number allocation pattern is determined according to the mode. The correspondence of mode to the bit number allocation pattern is, for example, as follows:

| | |
|---|---|
| mode 0 | (0, 0, 0, 0, 0) |
| mode 1 | (8, 5, 5, 8, 5) |
| mode 2 | (8, 5, 8, 5, 5) |
| mode 3 | (8, 5, 5, 5, 5) |

Because the number of bits is 0 in all subframes in mode 0 above, the adaptive codebook is not used. In the above bit number allocation patterns, lags are represented by differentials in subframes in which the number of bits is 5, while the lags are represented not by differentials but by absolute values in 8-bit subframes.

In this way, because a construction is employed in which the speech in a frame is classified among a plurality of modes, and, according to the mode, either the position of subframes using differential expression or the allocated number of bits when using differential representation is determined, not only can both the information to be transmitted from the adaptive codebook section and the bit rate be reduced in comparison with the prior art, but speech reproduction can be provided that suffers little degradation even when lag corresponding to pitch period varies over time in speech transient portions.

To achieve the above-described second object of the present invention, the second speech coding device according to the present invention comprises:

frame splitter section that receives an incoming speech signal, divides said speech signal into frames of a predetermined time length, and splits the speech signal of each of said frames into a plurality of subframes;

spectral parameter calculator section that calculates spectral parameters that represent a spectral characteristic of said speech signal;

spectral parameter quantizer section that quantizes the spectral parameter for each subframe using a quantization codebook;

impulse response calculator section that receives outputs of said spectral parameter calculator section and outputs of said spectral parameter quantizer section and calculates impulse responses of a spectral noise weighting filter;

spectral noise weighting section for executing spectral noise weighting of said speech signal according to the spectral parameter supplied from said spectral parameter calculator section to generate a spectrally weighted speech signal;

adaptive codebook section that receives a spectrally weighted speech signal, said impulse response, and a previous excited speech sound source signal calculated by a known method, calculates a lag corresponding to a pitch period of the speech signal every subframe, and outputs both the calculated result and an adaptive codebook predictive residual signal;

excitation quantizer section that selects an optimum excitation codevector from an excitation codebook such that error power between said adaptive codebook predictive residual signal and a speech signal synthesized from the excitation codevector selected from the excitation codebook minimizes;

gain quantizer section that selects an optimum gain codevector such that error power between said adaptive codebook predictive residual signal and a speech signal synthesized from both said optimum excitation codevector and a gain codevector selected from the gain codebook minimizes;

multiplexer section for multiplexing the parameters extracted from said spectral parameter calculator section and from said adaptive codebook section, and indexes indicating the optimum excitation codevector and the optimum gain codevector;

said adaptive codebook means comprising:

a lag calculator that receives a spectrally weighted speech signal ($x_w(n)$), said impulse response ($h_w(n)$) and an excited speech sound source signal ($v(n-T)$) one pitch period previously calculated according to a known method, calculates a lag ($T^k$) of a current subframe (k), and further, calculates a gain ($\beta$) of a predicted value of an auto-correlation coefficient for the predicted power of a speech signal;

a subframe delay section that receives quantized lag predictive residuals ($e_h^k$) of the present subframe (k) and outputs a lag predictive residual ($e_h^{k-1}$) of an immediately preceding subframe (k−1);

a lag predictor that receives the prediction coefficient codebook and, from the subframe delay section, the lag predictive residuals ($e_h^{k-1}$) for the immediately preceding subframe, reads a prediction coefficient ($\eta$) from the prediction coefficient codebook and calculates a predictive lag ($T_h=\eta e_h^{k-1}$), and further, generates lag predictive residuals ($e^k=T^k-T_h$) of the current subframe;

a differential quantizer that is supplied with a lag predictive residual ($e^k$) of the current subframe and outputs a quantized lag predictive residual ($e_h^k$);

a lag reproduction section that is supplied with both a predictive lag ($T_h$) from said lag predictor and a quantized lag predictive residual ($e_h^k$) from said differential quantizer and reproduces a lag ($T'^k$); and a pitch predictor that is supplied with a spectrally weighted speech signal ($x_w(n)$), said impulse response ($h_w(n)$), and an excited speech sound source signal ($v(n-T)$) one pitch period previous calculated according to a known method, further supplied with a gain ($\beta$) from said lag calculator, also supplied with reproduced lag ($T'^k$) from said lag reproduction section, and calculates an adaptive codebook predictive residual signal ($z(n)=x_w(n)-\beta v(n-T'^k)*h_w(n)$).

The adaptive codebook section in this way predicts lag from previous quantized differential values and quantizes differentials obtained by prediction.

As a first modification of the second speech coding device of the present invention, the adaptive codebook section can be further provided with:

a discrimination section that further calculates the lag predictive residual ($e^k$), and outputs a first predictive discrimination signal when the absolute value of said lag predictive residual is judged to be smaller than a reference value, and outputs a second predictive discrimination signal when the absolute value of said residual is judged to be larger than the reference value; and a switch section that, under the control of said first predictive discrimination signal, connects the reproduced lag ($T'^k$) to said pitch predictor, and, under the control of said second predictive discrimination signal, connects the lag ($T^k$) of said current subframe to said pitch predictor.

A second modification of the second speech coding device according to the present invention may also include a mode discrimination section that extracts a characteristic quantity of the speech signal in each frame, compares a numerical value that represents this characteristic quantity with a reference value, classifies the speech signal into one of a plurality of predetermined speech modes, and provides a mode discrimination signal corresponding to each speech mode, wherein said adaptive codebook section includes a switch section that connects the reproduced lag ($T'^k$) to said pitch predictor when the mode discrimination signal belongs to a prescribed speech mode.

As a third modification of the second speech coding device of the present invention, a mode discrimination section can be added to the above-described first modification, that extracts a characteristic quantity of a speech signal in every frame, compares a numerical value that represents the characteristic quantity with a reference value, defines a plurality of speech modes, and outputs a mode discrimination signal corresponding to each speech mode. In this case, the discrimination section of the adaptive codebook section executes discrimination of the lag predictive residual ($e^k$) when the mode discrimination signal indicates a prescribed speech mode.

To achieve the above-described third object of the present invention, the third speech coding device according to the present invention comprises:

frame splitter section that receives an incoming speech signal, divides said speech signal into frames of a predetermined time length, and splits the speech signal of each of said frames into a plurality of subframes;

spectral parameter calculator section that calculates spectral parameters that represent a spectral characteristic of said speech signal;

spectral parameter quantizer section that quantizes the spectral parameter for each subframe using a quantization codebook;

impulse response calculator section that receives outputs of said spectral parameter calculator means and outputs of said spectral parameter quantizer means and calculates impulse responses of a spectral noise weighting filter;

spectral noise weighting section for executing spectral noise weighting of said speech signal according to the spectral parameter supplied from said spectral parameter calculator section to generate a spectrally weighted speech signal;

adaptive codebook section that receives a spectrally weighted speech signal, said impulse response, and a previous excited speech sound source signal calculated by a known method, calculates a lag corresponding to a pitch period of the speech signal every subframe, and outputs both the calculated result and an adaptive codebook predictive residual signal;

excitation quantizer section that, using an approximation equation, selects an optimum excitation codevector that minimizes error power between said adaptive codebook predictive residual signal and a speech signal synthesized from an excitation codevector selected from an excitation codebook; and a correction codebook that stores, as correction values, values of deviation from true values, produced by said approximation equation when said excitation quantizer section operates using a known approximation equation to minimize said error power, wherein the values of the deviation are calculated in advance.

The operation of the third speech coding device according to the present invention will be given below.

A speech signal is divided into frames (for example 40 ms) which are in turn divided into subframes (8 ms). A vector quantization codebook is prepared in advance for quantizing both the speech signal and excitation signal for every subframe, and a predetermined number ($2^B$: here, B is the number of bits of the vector quantization codebook) of codevectors are stored. The correction value $\Delta_j$ or $\Delta_j'$ of the equation below is calculated in advance for at least one codevector $c_j(n)$. In the codevector search, while the above-described equation (2) is followed, equation (10) or equation (11) below is used in place of equation (5) in calculating the denominator of the second term on the right side of equation (2):

$$R_j^2 \approx \mu_j(0)\nu(0)+2\Sigma^{L-1}\mu_j(i)\nu(i)+\Delta_j \quad (10)$$

$$R_j^2 \approx \mu_j(0)\nu(0)+2\Sigma^{L-1}\mu_j(i)\nu(i)+\Delta'_j\nu(0) \quad (11)$$

Here, $\Sigma^{L-1}$ stands for the sum from i=1 to i=L−1, correction values $\Delta_j$ and $\Delta'_j$ are the quantities indicating the deviations from the true value calculated according to equation (4), and these quantities are determined statistically by preliminary measurements with regard to a large number of training speech signals.

As a first modification of the third speech coding device of the present invention, a plurality (K) of patterns of series of said impulse responses are established for each excitation codevector ($c_j$); the device further comprising a classification section for classifying a series of impulse responses calculated from incoming speech signals into one of said plurality of patterns, and said correction codebook storing correction values ($\Delta_{j1}$, $\Delta_{j2}$, $\Delta_{j3}$ . . . . $\Delta_{jK}$) calculated in advance corresponding to said patterns; and said excitation quantizer section corrects error power using correction values corresponding to these classified patterns.

This modification is constituted, taking account of the fact that the correction values for equations (10) and (11) depend on the impulse response, such that a plurality of correction values $\Delta_{jk}$ or $\Delta'_{jk}$ (k=1,2, . . . K) of equation (10) or (11) are set up in advance according to impulse response calculated from the speech signal, and these correction values can be switched according to the impulse response.

According to a second modification of the third speech coding device of the present invention, the impulse response calculator section calculates impulse responses to two orders, $L_1$ and $L_2$ ($L_1<L_2$), and the impulse responses of order $L_1$ are supplied to the adaptive codebook section; the speech coding device further comprising discrimination section that compares the correction value with a reference value, and according to the comparison result, supplies impulse responses of either order $L_1$ or order $L_2$ to the excitation quantizer section.

The present modification as well employs approximated equation (5) when searching the codebook. The feature of the present modification is that the correction value $\Delta_j$, or $\Delta'_j$, of equation (10) or (11) is calculated in advance for at least one codevector $c_j$, and when this value exceeds a set value, it is judged that a predetermined condition has been met, and the order L of the impulse response in equation (5) is changed. As one possible change that can be considered, L may be increased.

As a further modification of the first modification of the third speech coding device of the present invention, the impulse response calculator section calculates series of impulse responses to two orders, $L_1$ and $L_2$ ($L_1<L_2$), and the series of impulse responses of order $L_1$ is supplied to the adaptive codebook section; the speech coding device further comprises a discrimination section that compares the correction value ($\Delta_{jK}$)corresponding to the classified pattern with a reference value, and according to the result of comparison, supplies the series of impulse responses of either order $L_1$ or $L_2$ to the excitation quantizer section together with the correction value.

This modification has the following feature:

A plurality of correction values $\Delta_j$ or $\Delta'_j$ of equation (10) or (11) are calculated in advance corresponding to impulse response patterns obtained from speech signals, and when a selected correction value exceeds the reference value, the degree L of the impulse response in equation (5) changes.

The above and other objects, features, and advantages of the present invention will become apparent from the following description referring to the accompanying drawings which illustrate examples of preferred embodiments of the present invention.

DETAILED DESCRIPTION OF THE PREFERRED EMBODIMENTS

The basic construction and operation of the speech coding device of the present invention will first be explained.

Figure 1:
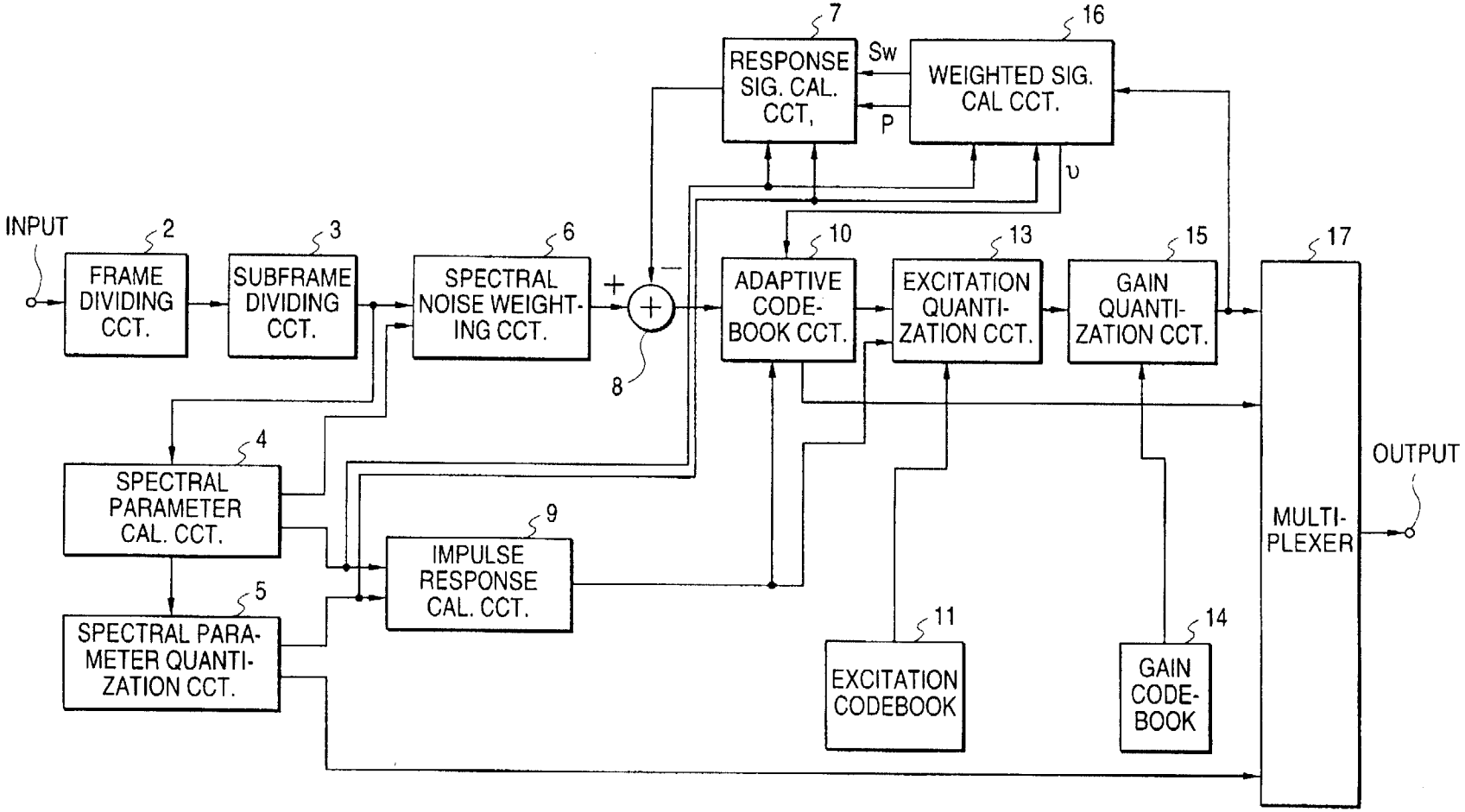
FIG. 1 is a block diagram showing the basic construction of a speech coding device for implementing the present invention.

FIG. 1 is a block diagram showing the basic construction of the speech coding device of the present invention.

In FIG. 1, the speech signal is received at input terminal 100. The frame dividing circuit 2 divides the speech signal into frames (for example, 40 ms), and the subframe dividing circuit 3 divides one frame of the speech signal into subframes that are shorter (for example, 8 ms) than one frame.

A spectral parameter calculation circuit 4 extracts a speech signal by applying a window longer than a subframe (for example, 24 ms) to a speech signal of at least one subframe, and calculates a spectral parameter to a predetermined order P (for example, P=10 orders).

Because spectral parameter varies widely over time, particularly at a transient interval between a consonant and a vowel, it is preferable to perform linear prediction analysis at a short time interval. However, since this would require a great amount of operations for analysis, the spectral parameter is calculated in the present invention only for a number L (L>1) of the subframes in each frame (for example, let L=3, and the first, third, and fifth subframes are analyzed).

For the unanalyzed subframes (in this case, the second and fourth subframes), the values obtained by linear interpolation of the spectral parameters for the first and third subframes and the third and fifth subframes through LSP (Linear Spectral Pairs) analysis (to be explained) are used for the spectral parameters.

In the calculation of the spectral parameters, while a well-known method such as LPC analysis (Linear Predictive Coding) or Burg analysis can be used, Burg analysis is employed in the embodiments of the present invention. For details regarding the Burg analysis, which is a spectral estimation method based on a Maximum Entropy Method (MEM), reference may be made to Signal Analysis and System Identification by Nakamizo (Corona Publishing Co., 1988), pp. 82–87, and explanation of the method are omitted here.

The spectral parameter calculation circuit 4 further converts the linear predictive coefficients $a_i$ (i=1–10) calculated by the Burg method to LSP parameters appropriate for quantization and interpolation by known methods. Reference may be made to Sugamura et al., "Speech data compression by linear spectral pair (LSP) speech analysis-synthesis method," Journal of the Electronic Communication Institute, J64-A, pp. 599–606, 1981. Further, in LSP analysis, spectral parameters are given as contiguous line spectrum pairs on a frequency axis and are therefore advantageous for improving quantization efficiency on the frequency axis.

In the following embodiments, the spectral parameter calculation circuit 4 converts the linear predictive coefficients calculated by the Burg method for the first, third and fifth subframes to LSP parameters, computes the LSP for the second and fourth subframes by linear interpolation from these LSP parameters and converts the LSP for the second and fourth subframes back to linear predictive coefficients by reverse conversion, and supplies the linear predictive coefficients $a_{iq}$ (i=1–10, q=1–5) of the first to fifth subframes to the spectral noise weighting circuit 6.

The spectral parameter calculation circuit 4 supplies the LSP of the first to fifth subframes to the spectral parameter quantization circuit 5 as well.

The spectral parameter quantization circuit 5 efficiently quantizes the LSP parameters of the predetermined subframes.

Quantization of the LSP parameter is effected for the fifth subframe in the following embodiments, in which vector quantization is employed as the quantization method. A well-known method can be employed as the vector quantization method of the LSP parameters. For details of the actual method employed, reference may be made to, for example, the series of inventions by the inventor of the present invention, i.e., Japanese Patent Laid-open No. 4-171500 (Japanese Patent Application No. 2-029700), Japanese Patent Laid-open No. 4-363000 (Japanese Patent Application No. 3-261925) or Japanese Patent Laid-open No. 5-006199 (Japanese Patent Application 3-155949). Reference may also be made to T. Nomura et al., "LSP coding using VQ-SVQ with interpolation in 4.075 kbps M-LCELP speech coder" (IEEE Proc. Mobile Multimedia Communications, pp. B.2.5, 1993).

Based on the quantized LPS parameter of the fifth subframe, the spectral parameter quantization circuit 5 computes the LSP parameters of the first to fourth subframes.

In the following embodiments, the LSP of the first to fourth subframes are reproduced by linear interpolation of the quantized LSP parameters of the fifth subframes of the current and preceding frames.

In this case, the LSP of the first to fourth subframes can be reproduced by linear interpolation after selecting one of the codevectors that minimizes the error power between the LSPs before and after quantization.

In order to improve performance, the spectral parameter quantization circuit 5, after selecting a plurality of candidate codevectors that minimize the aforesaid error power, evaluates an accumulated distortion for each candidate, and a combination of the interpolated LSP and the candidate that minimizes the accumulated distortion can be selected. Details are described in the specification of the present inventor's Japanese Patent Laid-open No. 6-222797.

The spectral parameter quantization circuit 5 converts the quantized LSP of the fifth subframe and the LSP of the first to fourth subframes that have been reproduced by the above-described process to linear predictive coefficients $a'_{iq}$ (i=1–10, q=1–5) for every subframe and supplies the coefficients $a'_{iq}$ to the impulse response calculation circuit 9. The spectral parameter quantization circuit 5 also supplies an index indicating codevectors of the quantized LSP for the fifth subframe to a multiplexer 17.

In the above-described processes executed by the spectral parameter quantization circuit 5, LSP interpolation patterns of a predetermined bit number(for example, 2 bits) may also be prepared instead of linear interpolation. In this case, the LSPs of the first to fourth subframes can be reproduced for each of these patterns, the accumulated distortions for the reproduced LSPs are evaluated, and a combination of interpolated pattern and codevector that minimizes the accumulated distortion can be selected.

In this method, while transmitted information increases by the number of bits of the interpolation pattern, a time variation of LSP within the frame can be more precisely indicated.

As an interpolation pattern, the pattern produced by learning SP training data in advance, or known patterns stored in advance may be employed. For example, it is possible to use a pattern described in T. Taniguchi et al., "Improved CELP speech coding at 4 kbits/sec and below" (Proc. ICSLP, pp. 41–44, 1992) Nomura et al.

To further improve performance, it is also possible to determine, after selecting an interpolation pattern, an error signal between the true LSP value and the interpolated LSP value for predetermined subframes, and indicate the error signal by a code described in the error codebook. For particulars, reference may be made to Nomura et al.

The spectral noise weighting circuit 6 receives, from the spectral parameter calculation circuit 4, linear predictive coefficients $a_{iq}$ (i=1–10, q=1–5) for every subframe before quantization, and based on the method described in the method of the present inventor, Ozawa, described in Japanese Patent Laid-open quoted above, provides a spectrally weighted speech signal $x_w(n)$ for the speech signal of the subframe. A response signal calculation circuit 7 receives from the spectral parameter calculation circuit 4 the linear predictive coefficients $a_{iq}$ for every subframe, and also receives, every subframe, linear predictive coefficients $a'_{iq}$ reproduced after quantization and interpolation from the spectral parameter quantization circuit 5, calculates response signals for one subframe, responsive to the input signal d(n)=0 using stored values in a filter memory, and supplies the response signal to a subtracter 8. Here, the response signal $x_z(n)$ is represented by the following equation (12):

$$x_z(n)=d(n)-\Sigma^i\alpha_i d(n-i)+\Sigma^i\alpha_i\gamma^i y(n-i)+\Sigma^i\alpha'_i\gamma^i x_z(n-i) \quad (12)$$

Here, $\Sigma^i$ is a sum from i=1 to i=10, and $\gamma$ is the weighting coefficient that controls the amount of spectral noise weighting and is identical to the $\gamma$ in the equation (14) below. If $n-i \leqq$, then it holds that $y(n-i)=p(N+(n-i))$ and $x_z(n)=s_w(N+(n-i))$, N being a length of a subframe.

The subtracter 8 subtracts response signals $x_z(n)$ for one subframe from the spectrally weighted speech signal $x_w(n)$ according to the following equation (13) and supplies the $x'_w(n)$ to the adaptive codebook circuit 10.

$$x'_w(n)=x_w(n)-x_z(n) \quad (13)$$

The impulse response calculation circuit 9 calculates a predetermined point number L of impulse responses $h_w(n)$ of the weighting filter having a transfer function expressed by the z-transformation representation represented by the following equation (14), and supplies the impulse response to the adaptive codebook circuit 10 and an excitation quantization circuit 13.

$$H_w(z)=[(1-\Sigma^i\alpha_i z^{-i})/(1-\Sigma^i\alpha_i\gamma^i z^{-i})]/[1/(1-\Sigma^i\alpha'_i\gamma^i z^{-i})] \quad (14)$$

The adaptive codebook circuit 10 finds pitch parameter. When the lag for every subframe is determined by the adaptive codebook circuit 10, indexes corresponding to these lags are supplied to the multiplexer 17.

The adaptive codebook circuit 10 carries out pitch prediction according to the following equation (15) and provides an adaptive codebook predictive residual signal z(n).

$$z(n)=x'_w(n)-b(n) \quad (15)$$

Here, b(n) is an adaptive codebook pitch predictive signal which is given by the following equation (16):

$$b(n)=\beta 0\ v\ (nT) * h_w\ (n) \quad (16)$$

Here $\beta$ and T represent the adaptive codebook gain and lag, respectively, $h_w(n)$, v(n) represent the outputs of impulse response calculation circuit 9 and weighted signal calculation circuit 16, respectively, and operation symbol * represents convolution.

Again, referring to FIG. 1, the excitation quantization circuit 13 selects optimum excitation codevectors such that the following equation (17) is minimized for all or a part of the excitation codevectors $c_j(n)$ stored in the excitation codebook 11.

In this case, a single optimum codevector may be selected, or a plurality of codevector may be provisionally selected to select a final codevector at the time of gain quantization. In the following embodiments, two or more codevectors are first selected.

$$D_j=\Sigma[z(n)-\gamma_j c_j(n)*h_w(n)]^2 \quad (17)$$

Here Σ represents the sum over a predetermined sampling time n.

If the above equation (17) is to be applied to only a part of excitation codevectors, a plurality of excitation codevectors are provisionally selected in advance and the above equation (17) is applied to the selected excitation codevectors.

The gain quantization circuit 15 reads out gain codevectors from the gain codebook 14 and, for the selected excitation codevectors, selects combinations of excitation codevectors and gain codevectors such that the following equation (18) is minimized:

$$D_{j,k}=\Sigma[x_w(n)-\beta'_k v(n-T)*h_w(n)-\gamma_k c_j(n)*h_w(n)]^2 \quad (18)$$

Here, $\beta'_k$ and $\gamma_k$ are the $k^{th}$ codevectors in the two-dimensional gain codebook stored in the gain codebook 14, and Σ represents the sum over a predetermined sampling time n.

Indexes indicating the selected excitation codevector and gain codevector are supplied to the multiplexer 17.

A weighted signal calculation circuit 16 receives the parameter supplied from the spectral parameter calculation circuit and each of the indexes, reads from these indexes the corresponding codevectors, and first determines excited speech sound source signal v(n) based on equation (19). The signal v(n) is supplied to the adaptive codebook circuit 10:

$$v(n)=\beta'_k v(n-T)+\gamma_k c_j(n) \quad (19)$$

Next, using the output parameter of the spectral parameter calculation circuit 4 and the output parameter of the spectral parameter quantization circuit 5, the weighted signal calculation circuit 16 calculates a spectrally weighted speech signal $s_w(n)$ for every subframe according to the following equation (20) by means of a weighting filter having a transfer function expressed by equation (14) and supplies the signal $s_w$ to the response signal calculation circuit 7:

$$s_w(n)=v(n)-\Sigma^i a_i v(n-i)+\Sigma^i a_i\gamma^i p(n-i)+\Sigma^i a'_i\gamma^i s_w(n-i) \quad (20)$$

where $\Sigma^i$ represents the sum from i=1 to i=10 as defined above, $1\leqq\leqq N$, N being a subframe length, and p(n) represents the output of the filter having a transfer function expressed by the denominator of the first factor of the right side of equation 20.

Next, an explanation will be given regarding an embodiment of the present invention applied to the circuit of FIG. 1.

Figure 2:
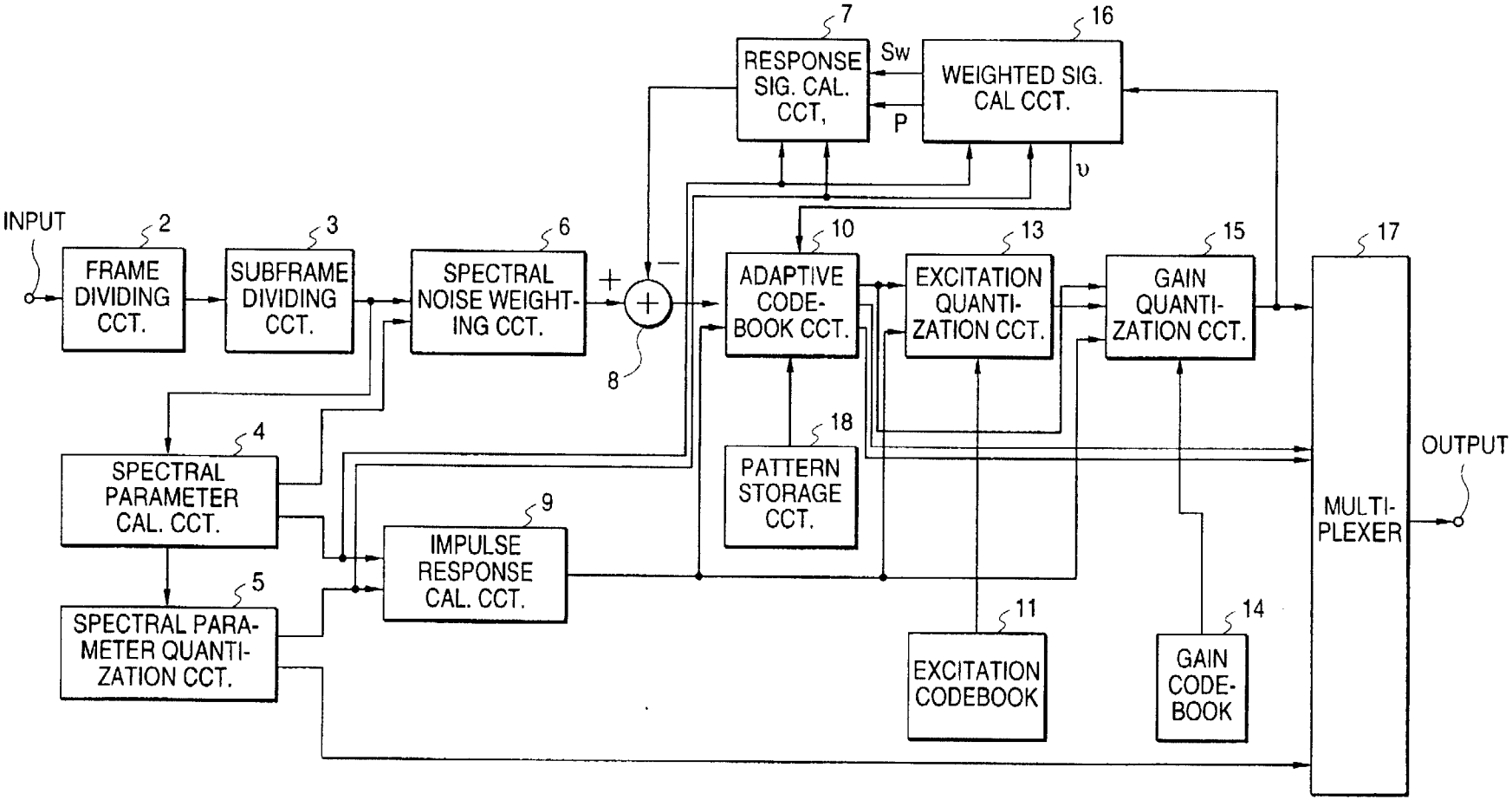
FIG. 2 is a block diagram showing a first embodiment of the present invention.

FIG. 2 is a block diagram of the first embodiment of the present invention. Constituent elements of FIG. 2 denoted by the same reference numerals as elements in FIG. 1 have the same function as the corresponding elements in FIG. 1, and explanation regarding these elements will therefore be omitted. Explanation will be limited to only those points of FIG. 2 that differ from FIG. 1.

In the present embodiment are established for every frame the numbers of the subframes for which lags corresponding to the pitch period of the speech signal of each subframe is represented in absolute values, i.e., the values calculated as is (hereinafter, referred to as a first mode of representation), and of subframes for which lags are represented as differentials relative to previous subframes (hereinafter, referred to as a second mode of representation); to each mode of representation, the number of bits is designated and the mode of representation is given to each subframe, whereby bit allocation patterns are established which reveal bit allocations with respect to positions of the subframes in a frame; a bit allocation pattern which minimizes the accumulated distortion is selected; and speech coding for each subframe is executed based on the selected bit allocation pattern. For this purpose, bit allocation patterns are stored in a pattern storage circuit 18. The adaptive codebook circuit 10 consults the bit allocation patterns stored in the pattern storage circuit 18 and calculates lag values.

The bit allocation patterns are determined as follows:

First, a plurality (M) of bit allocation patterns are prepared in advance. For the sake of simplifying the following explanation, M is set to equal 2, and the patterns, as described hereinabove, are set to be (8, 5, 8, 5, 5) and (8, 5, 5, 8, 5). In these patterns, 5-bit subframes indicate lag by differentials, and 8-bit subframes indicate lag in absolute values.

Figure 3:
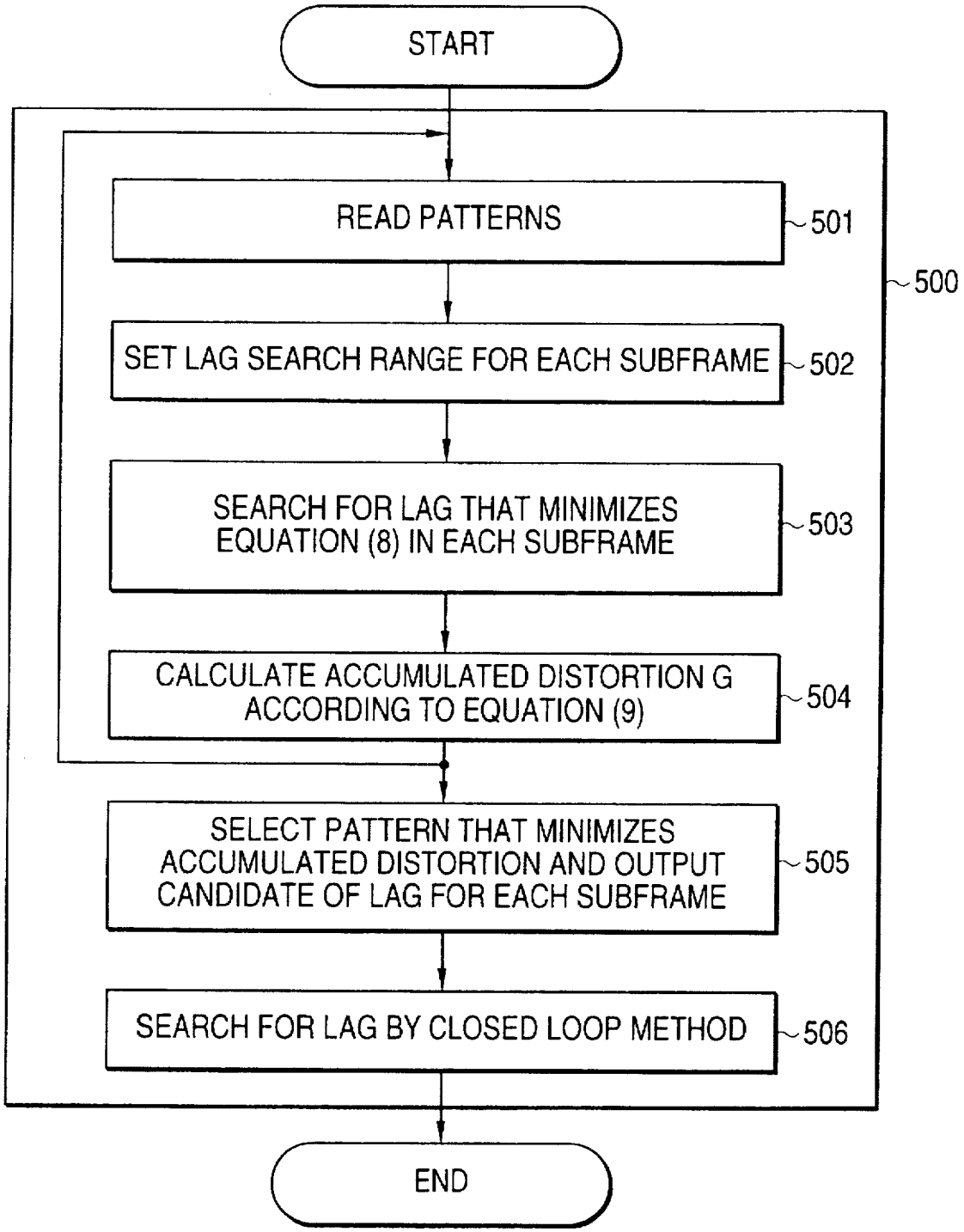
FIG. 3 is a flow chart illustrating the processes of the adaptive codebook circuit of the first embodiment of the present invention.

FIG. 3 shows the flow of processes for carrying out calculation of lag by a microprocessor or the like.

Referring to FIG. 3, the M types of bit allocation patterns stored in the pattern storage circuit 18 are first read in (Step 501). In accordance with the number of bits shown in the bit allocation patterns read in Step 501, the lag search range in each subframe is set (Step 502). Here, in subframes to which the first mode of representation is applied, the lag search range is expressed as $T_1\leqq T\leqq T_2$. As an example, if $T_1=20$ and $T_2=147$, and lag is represented by a decimal of a ½ basis, then the lag search range includes 256 lags, which can be expressed in 8 bits. In subframes using differential representation, the lag search range is $T_3\leqq T\leqq T_4$, and $T_1\leqq T_3<T4\leqq T_2$.

For a lag value $T_{j-1}$ in a preceding frame, the lag search range is set such that $T_3=T_{j-1}-15\Delta$ and $T_4=T_{j-1}+16\Delta$. Here, Δ represents an increment of lag and is set at, for example, ½.

Next, lag is searched for every subframe within the lag search range set for each subframe, distortion $G_j$ is calculated according to equation (8), and L ($L\geqq 1$) candidate lags are selected corresponding to L different values of $G_j$ in order from the smallest value (Step 503). Next, the distortion $G_j$ found for each subframe is accumulated over a number S of subframes to calculate accumulated distortion G (Step 504). S can be set to equal the total number of subframes contained in a frame. In Step 504, the above processes are repeated for the L different candidates and a combination of lags is selected to minimize the accumulated distortion G.

Thus, as shown in FIG. 3, the processes of Steps 501–504 are repeated for the M bit allocation patterns.

Next, the accumulated distortion G is compared with a distortion G for every other pattern, the pattern for which the accumulated distortion is a minimum is selected, and lag for each subframe included in the selected pattern is outputted (Step 505).

A search range is again set for each subframe based on the selected bit allocation pattern and the lag values for each subframe of the selected pattern, and an optimal lag is calculated by a closed loop method (Step 506). The calculation of lag by the closed-loop method here may be executed with reference to, for example, Kleijn et al. above.

Lags are calculated in this way for every subframe, and indexes corresponding to these lags are supplied to the multiplexer 17. In addition, the index indicating the selected bit allocation pattern is supplied to the multiplexer 17.

In the closed-loop search, each functional block of the speech coding device operates according to the foregoing explanation using formulae (15)–(20).

Figure 4:
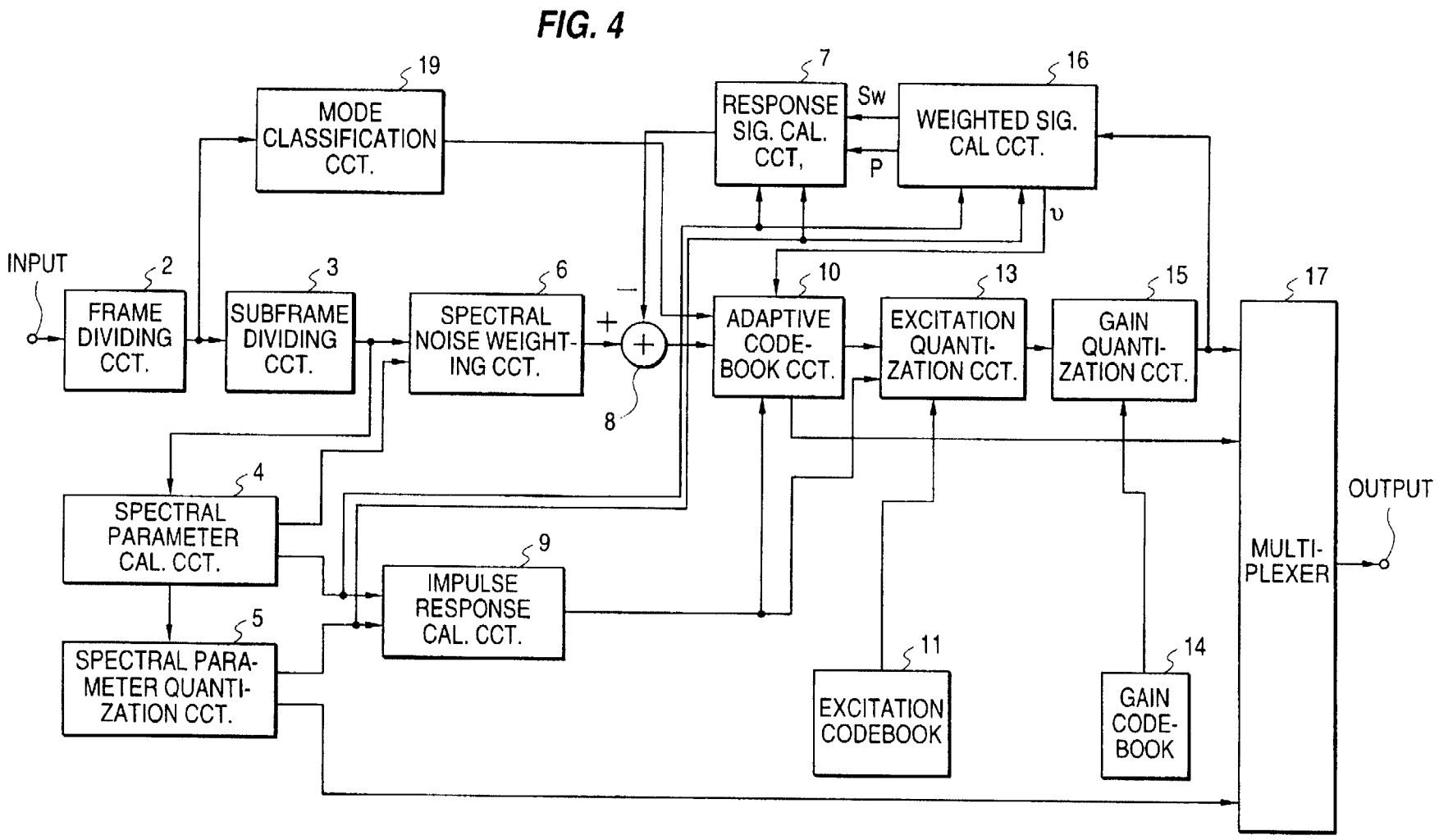
FIG. 4 is a block diagram showing the second embodiment of the present invention.

FIG. 4 is a block diagram showing a second embodiment of the speech coding device of the present invention. Constituent elements of FIG. 4 denoted by the same reference numerals as elements in FIG. 1 have the same function as the corresponding elements in FIG. 1, and explanation regarding these elements will therefore be omitted. Explanation will be limited to only those points of FIG. 4 that differ from FIG. 1. Explanation of the third and later embodiments will also be abbreviated in the same way.

In the present embodiment, characteristic quantity is calculated from a speech signal of each frame, and using this characteristic quantity, the speech signal is classified to one of a predetermined plurality of modes.

Referring to FIG. 4, a mode classification circuit 19, based on output of the frame dividing circuit 2, extracts the characteristic quantity from a speech signal every frame and classifies the speech signal as one of a plurality of modes.

In the following explanation, the number of modes is four, and the accumulated distortion G over the entire frame (refer to equation (9) above) is used as the characteristic quantity. According to the above-described method, the accumulated distortion G is calculated, and by comparing the calculated results to, for example, three predetermined reference values TH1~TH3, the speech mode of the frame is specified.

The mode classification circuit 19 supplies the mode information to the adaptive codebook circuit 10. The mode information is also supplied to the multiplexer 17.

Figure 5:
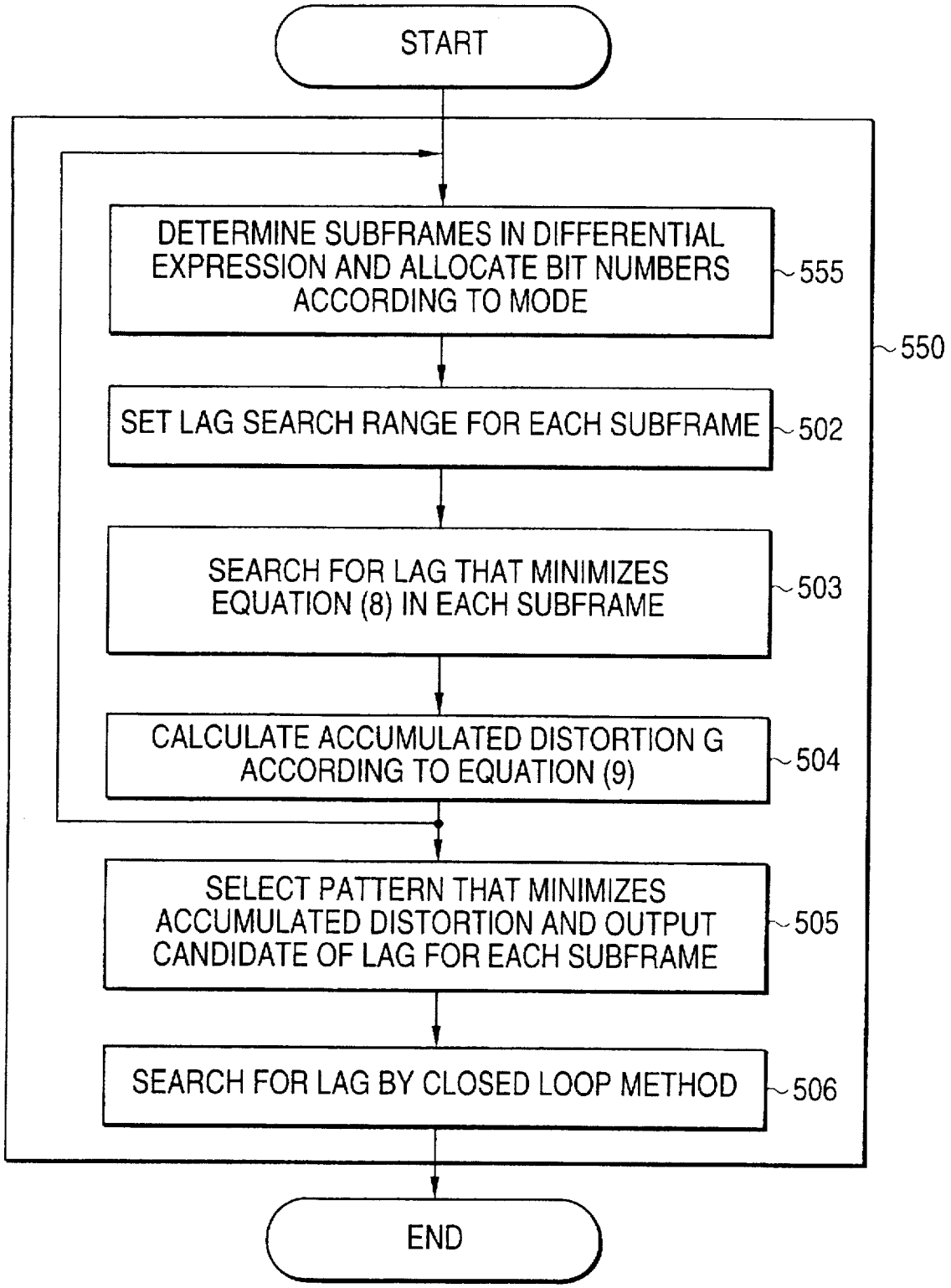
FIG. 5 is a flow chart illustrating the process of the adaptive codebook circuit of the second embodiment.

FIG. 5 is a flow chart showing the progression of processes of the adaptive codebook circuit 10 in the present embodiment.

Referring to FIG. 5, the adaptive codebook circuit 10 receives the mode information and determines the number of bits allotted for representing the lag and position of subframes in which lag is to be represented by differentials (Step 555). As described in the first embodiment hereinabove, the adaptive codebook circuit 10 establishes the lag search range in every subframe (Step 502), calculates distortion $G_j$ in every subframe using equation (8) above, selects L ($L \geqq 1$) candidate lags corresponding to L different values of $G_j$ in order from the smallest value (Step 503), and accumulates the distortions $G_j$ calculated for each of S subframes and calculates the accumulated distortion G (Step 504). The number S can be the total number of subframes contained within a frame. The above processes are repeated for the number of lag candidates L, and a lag combination is selected that minimizes the accumulated distortion G (Step 504).

The adaptive codebook circuit 10 then repeats the processes of steps 502~504 for the bit allocation pattern determined according to the mode in Step 555.

Next, the adaptive codebook circuit 10 selects the pattern that minimizes accumulated distortion and also outputs a lag candidate for each subframe (Step 505). The adaptive codebook circuit 10, consulting the candidate lag value for each subframe and bit allocation pattern selected through the above processes, sets the search range in each subframe, and calculates optimum lag by the closed-loop method (Step 506).

While the first and second embodiment have been described in details, many modifications are possible.

For example, the type of bit allocation pattern in the adaptive codebook circuit may be freely selected. Regarding the bit allocation patterns, while the optimum pattern is selected using an open-loop search in the above-described embodiments, selection may also be made using a closed-loop search.

In addition, in the above-described embodiments, while the position of subframes in which lags are expressed by differentials and the bits allocated to lag are shown simultaneously using M bit allocation patterns, it is also possible to express the positions of subframes using differential representation with $B_1$ bits and to express the number of bits allocated for the differential representation with a different number $B_2$ of bits.

Furthermore, in the second embodiment, it is possible to change the allocated number of bits used when expressing by differentials, the number, or the position of subframes expressed by the differential representation, depending on the mode as defined above.

It is further possible to use other well-known spectral parameters other than LSP.

In the spectral parameter calculation circuit, when calculating a spectral parameter at at least one subframe within a frame, it is possible to measure the change in RMS or the change in power between the preceding subframe and the current subframe, and calculate the spectral parameter only for those subframes in which these changes are substantial. In this manner, analysis of spectral parameter can be ensured for parts of change in speech, while preventing deterioration in performance even in cases when the number of analyzed subframes is reduced.

For spectral parameter quantization in the present invention, known methods such as vector quantization, scalar quantization, and vector-scalar quantization may be used.

Also, in selecting an interpolation pattern in the spectral parameter quantization circuit of the present invention, another well-known scale of distance may be used.

In the above-described embodiments, while explanation has been given regarding the case of one-stage codebook in the excitation quantization circuit 13, the codebook in the excitation quantization circuit may be of two-stage or multistage structure.

Still further, for the excitation codebook search, as well as for the distance scale when learning, a different well-known scale may also be employed.

In the gain quantization circuit 15, a gain codebook that has an overall area several times larger than the number of bits employed for transmission may then be learned in advance, each section of the area being assigned as employed for corresponding one of predetermined modes and switched over according to the mode when coding.

Figure 6:
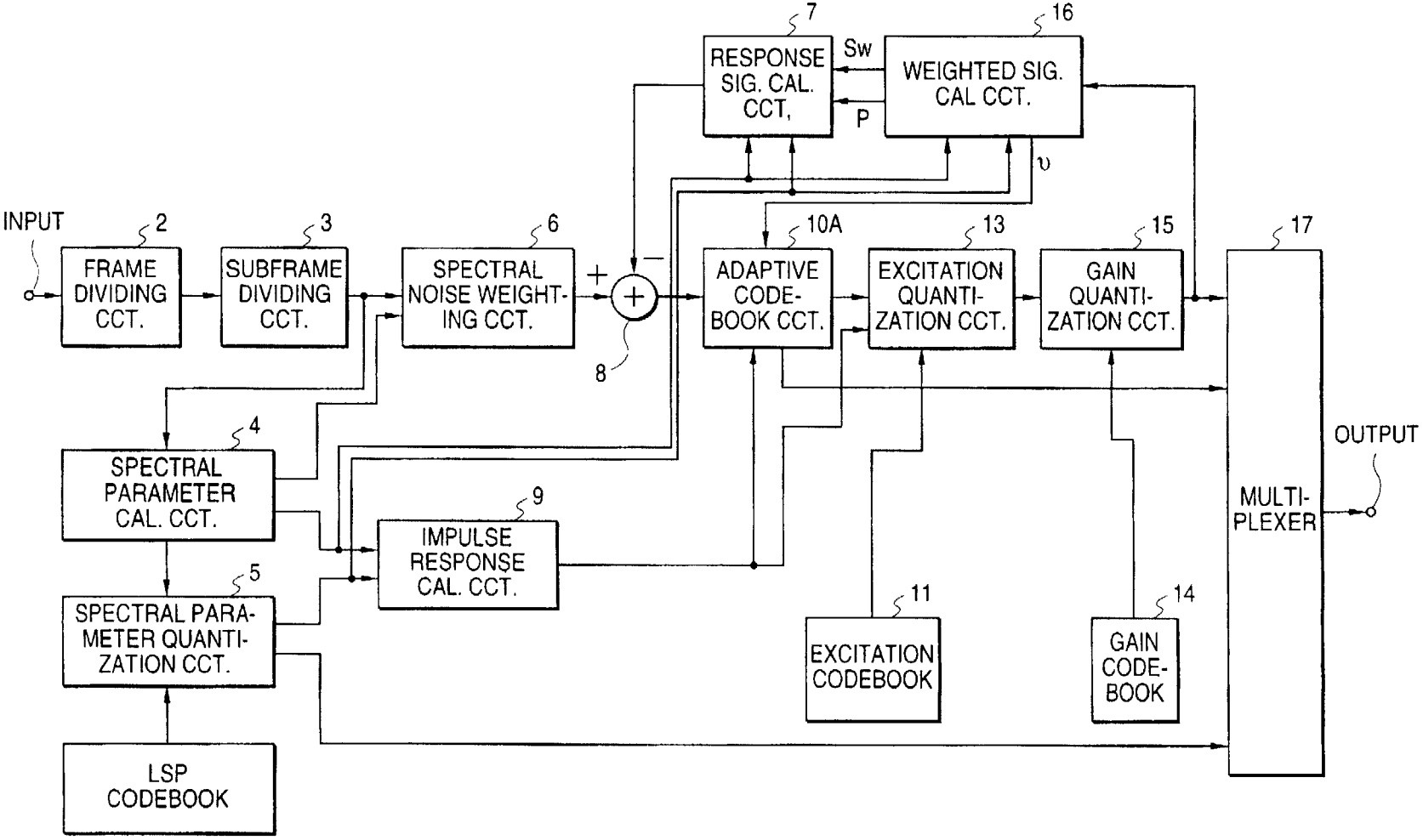
FIG. 6 is a block diagram showing a third embodiment of the present invention.
Figure 7:
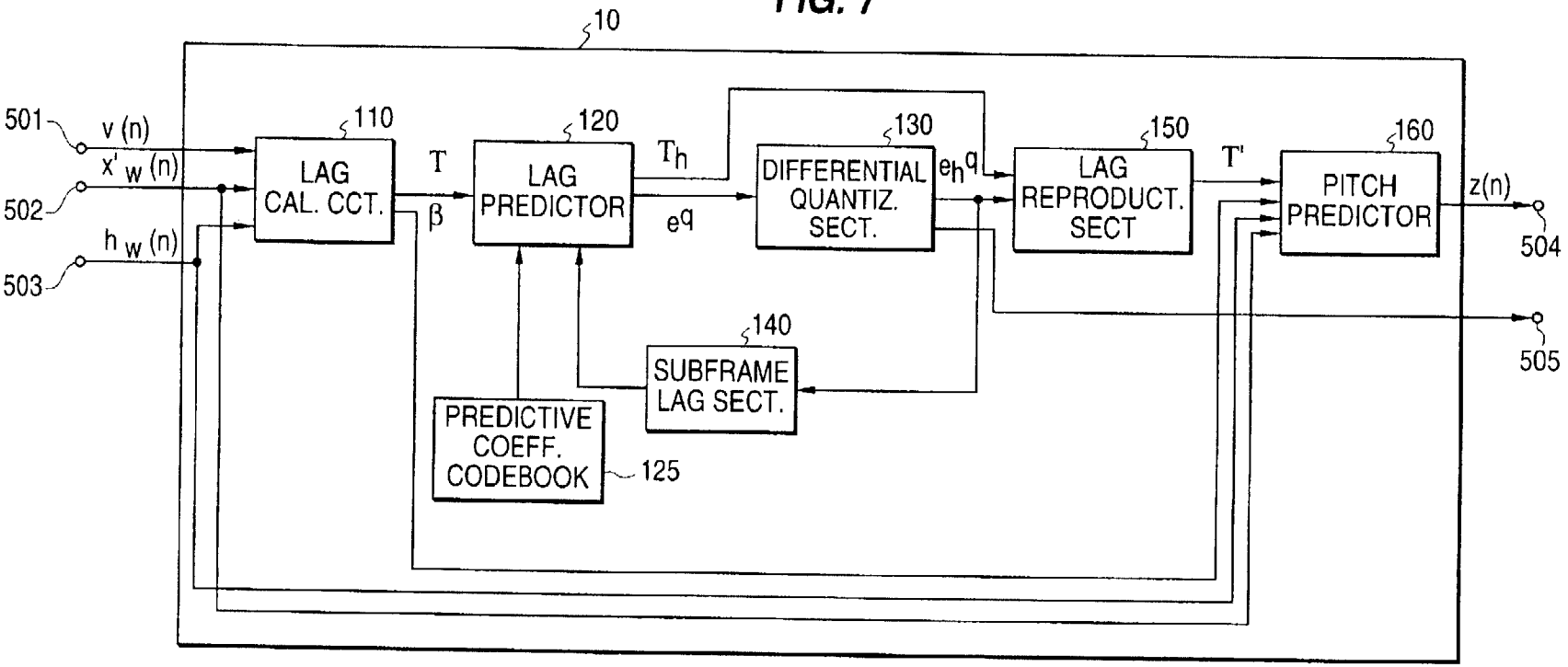
FIG. 7 is a block diagram showing an embodiment of the adaptive codebook circuit of FIG. 6.

FIG. 6 is a block diagram of the third embodiment of the speech coding device of the present invention, and FIG. 7 is a block diagram of the adaptive codebook circuit 10A of FIG. 6.

The device of FIG. 6 differs from the device of FIG. 1 in that the adaptive codebook circuit 10A is constructed so as to calculate the lag prediction value of the current subframe using the quantized differential of the lag in the immediately preceding subframe. Nevertheless, the overall structure of the speech coding device is similar to the device of FIG. 1.

In FIG. 7, the lag calculation circuit 110 receives the previous excitation signal v(n), the output signal $x'_w(n)$ of the subtracter 8, and the impulse response $h_w(n)$ from terminals 101, 102, 103, respectively, and finds lag T corresponding to the pitch that minimizes the following equation:

$$D_T=\Sigma^{N-1}x'_w(n)^2-[\Sigma^{N-1}x'_w(n)y_w(n-T)]^2/[\Sigma^{N-1}y_w(n-T)^2] \quad (21)$$

Here, $\Sigma^{N-1}$ denotes a sum from n=0 to n=N−1 inclusive, $$y_w(n-T)=v(n-T)*h_w(n) \quad (22)$$

and the symbol * indicates a convolution operation.

Gain β is calculated according to the following equation (23) and is supplied to the pitch predictor 160, to be explained.

$$\beta=\Sigma^{N-1}x'_w(n)y_w(n-T)/[\Sigma^{N-1}y_w(n-T)^2] \quad (23)$$

Here, in order to improve the lag extraction accuracy for the voice of, for example, a woman or child, lag can be determined to a decimal multiple rather than to an integer multiple of the sampling period. Regarding the actual method, reference may be made to, for example, P. Kroon, et al., "Pitch predictors with high temporal resolution" (Proc. ICASSP, pp. 661–664, 1990).

The lag predictor 120 receives lag T, a quantized differential of the lag of a previous subframe from the subframe lag section 140, a predictive coefficient from the predictive coefficient codebook 125, and predicts an MA (moving average) of the lag in the current subframe. As one example, a case will be described in which the quantized value of lag in one previous subframe is used for prediction.

Let the quantized differential of the lag in a subframe having subframe number q−1 be $e_h^{q-1}$, and the corresponding lag value be $T_h$, then $$T_h=\eta e_h^{q-1} \quad (24)$$

Here, η is a fixed predictive coefficient stored in the predictive coefficient codebook.

The differential quantization section 130 calculates the differential for subframe q according to the following equation:

$$e^q=T-T_h \quad (25)$$

The differential quantization section 130 quantizes the differential $e^q$ by representing the differential $e^q$ with a predetermined quantized number of bits, finds quantized value $e_h^q$ and supplies the quantized value $e_h^q$ to the lag reproduction section 550. The differential quantization section 130 further supplies the quantized value $e_h^q$ to the subframe lag section 140, and moreover, outputs an index indicating the quantized value $e_h^q$ through terminal 505.

The lag reproduction section 150 receives $T_h$ and $e_h^q$, and reproduces lag T' according to the following equation (26) and outputs it:

$$T'=T_h+e_h^q \quad (26)$$

The pitch predictor 160 generates adaptive codebook predictive residual signal z(n) according to the following equation (27) and supplies the signal z(n) from terminal 504 to the excitation quantization circuit 13.

$$z(n)=x'_w(n)-\beta v(n-T')*h_w(n) \quad (27)$$

Figure 8:
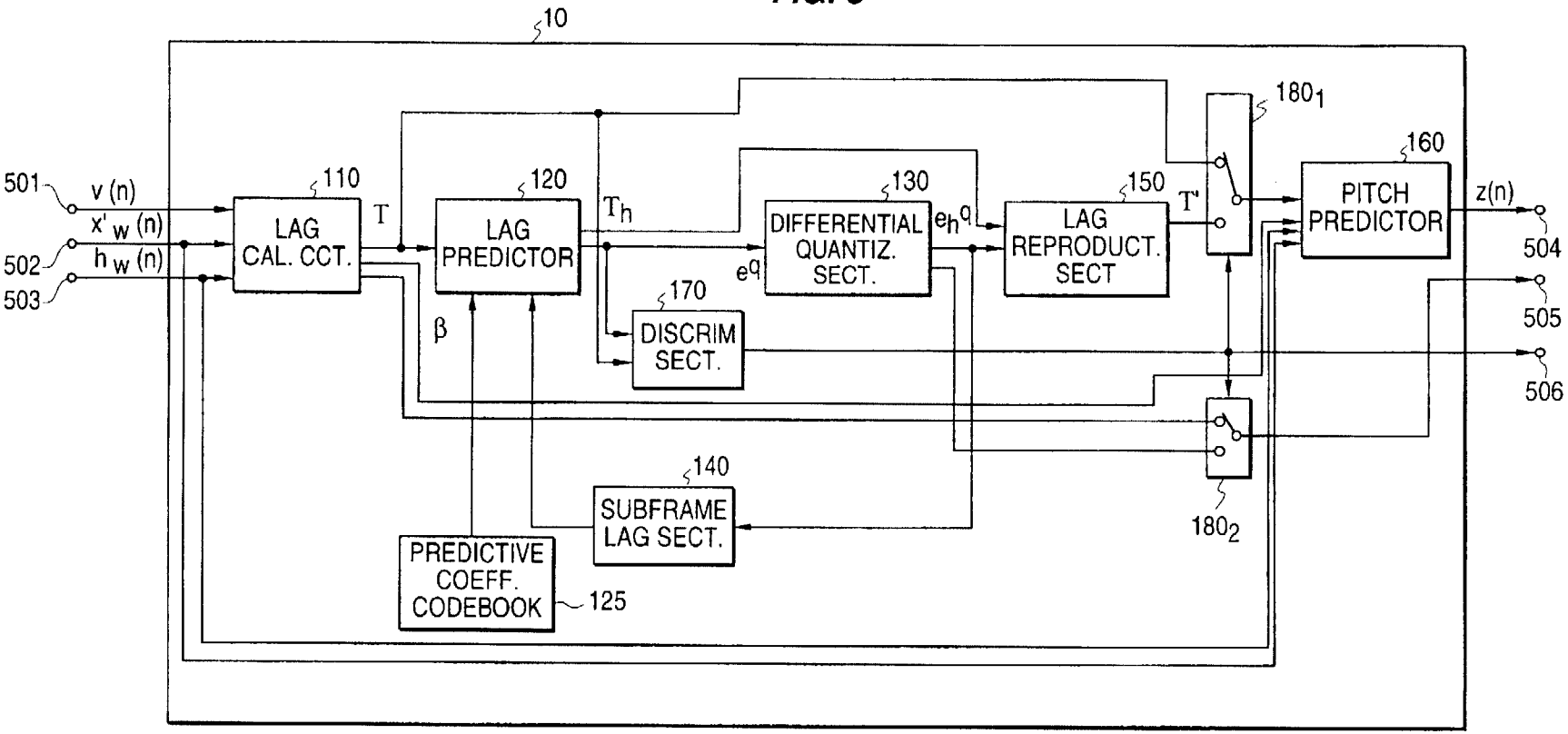
FIG. 8 is a block diagram showing the structure of the adaptive codebook circuit of the fourth embodiment of the present invention.

FIG. 8 is a block diagram of the adaptive codebook circuit 10 of the fourth embodiment of the speech coding device of the present invention. In the speech coding device of the present embodiment, only the structure of the adaptive codebook circuit 10 differs from that of the third embodiment, the two embodiments being otherwise identical. Accordingly, only the structure and operation of the adaptive codebook circuit 10 will be explained with reference to FIG. 8. Constituent elements in FIG. 8 denoted by the same reference numbers as elements of FIG. 7 perform the same operation as in FIG. 7, and explanation of these elements will therefore be omitted.

The adaptive codebook circuit of the present embodiment differs from the adaptive codebook circuit of the third embodiment in being provided with a discrimination section 170 and switches $\mathbf{180}_1$, $\mathbf{180}_2$. The discrimination section 170 receives the predictive lag $T_h$ supplied from the lag predictor 120 and the lag T of the current subframe q from the lag calculation section 110, and determines error (predictive residuals) using the following equation:

$$e^q=T-T_h \quad (28)$$

The discrimination section 170 compares the absolute value of the error $e^q$ with a predetermined threshold value, generates a predictive discrimination signal to perform prediction if the absolute value of the error $e^q$ is larger than the threshold value or not to perform prediction if less than the threshold value, and supplies this signal to switches $\mathbf{180}_1$ and $\mathbf{180}_2$ and terminal 506.

Switch $\mathbf{180}_1$ receives the predictive discrimination signal, connects the switch upward (as viewed in the figure) when there is no prediction and connects the switch downward when there is a prediction so as to supply lag T delivered from the lag calculation section 110 to the pitch predictor 160 when there is no prediction, and to supply T' delivered from the lag reproduction section 150 to the pitch predictor 160 when there is prediction. Switch $\mathbf{180}_2$ receives the prediction discrimination signal, supplies an index corresponding to lag T to terminal 505 when there is no prediction and supplies an index of the quantized differential value to terminal 505 when there is prediction.

Figure 9:
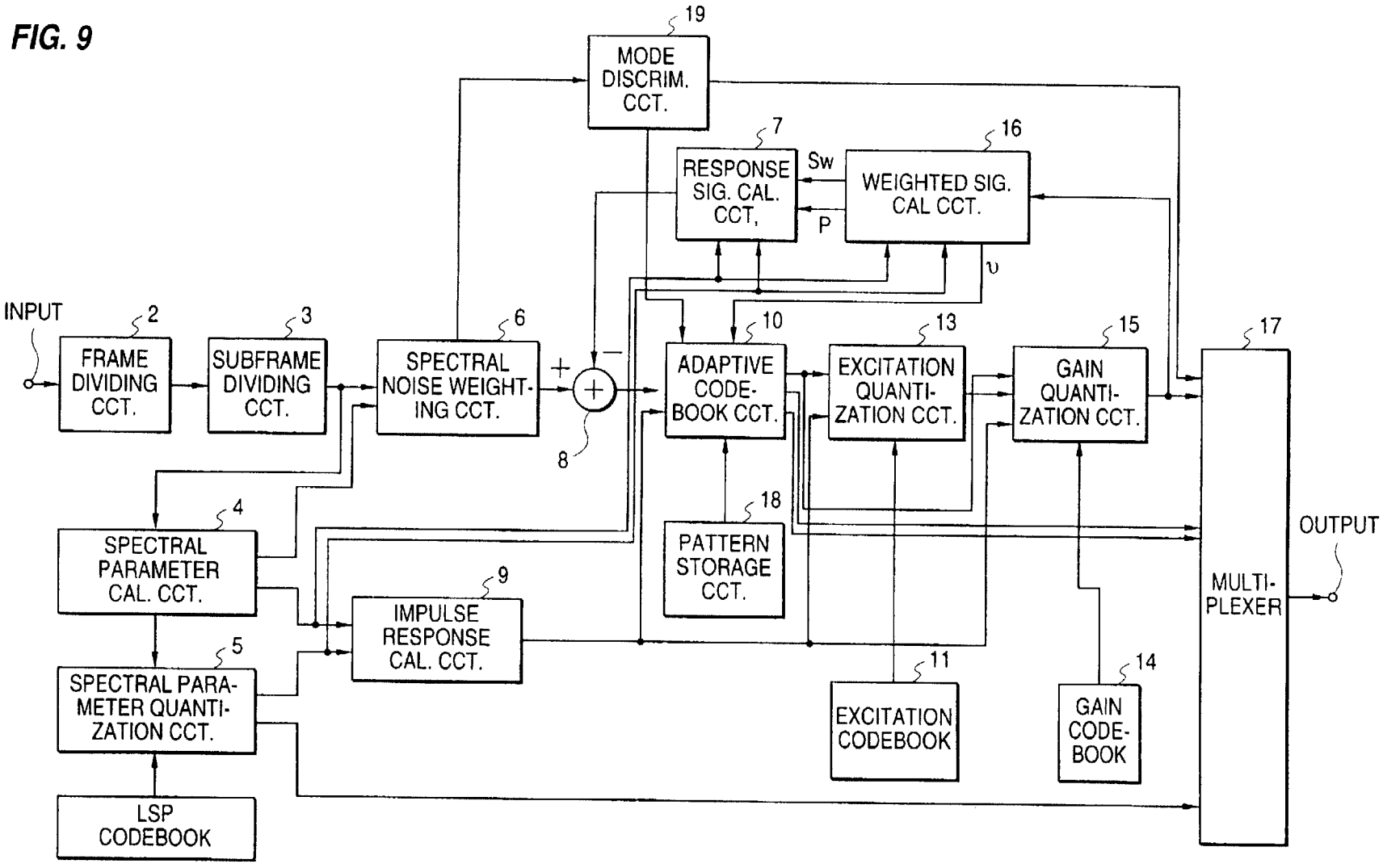
FIG. 9 is a block diagram of the fifth embodiment of the present invention.
Figure 10:
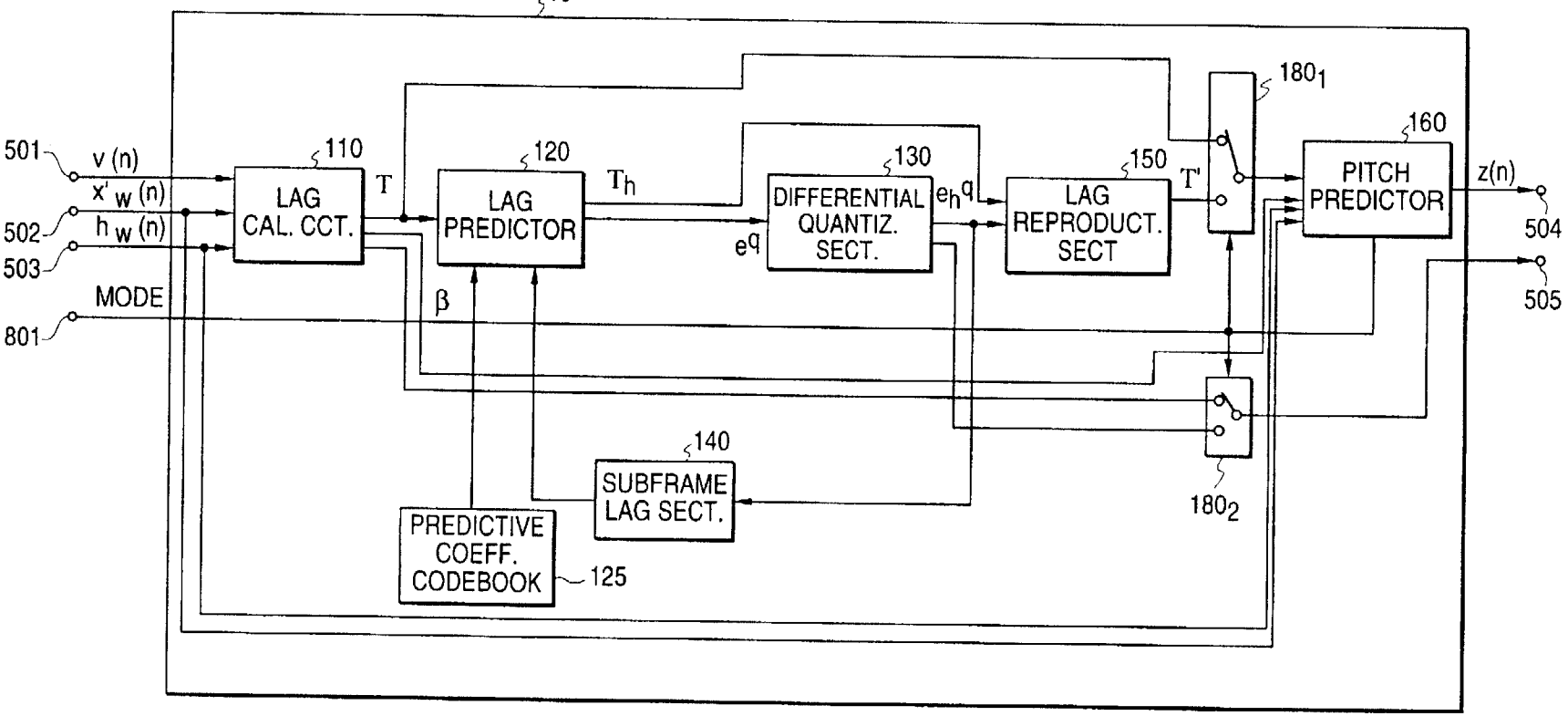
FIG. 10 is a block diagram showing the structure of the adaptive codebook circuit of FIG. 9.

FIG. 9 is a block diagram showing the fifth embodiment of the present invention, and FIG. 10 is a block diagram showing the structure of the adaptive codebook circuit 10 of FIG. 9. In FIG. 9, the mode discrimination circuit 19 receives a spectrally weighted speech signal in frame units from the spectral noise weighting circuit 6 and provides mode discrimination information. In the present embodiment, the characteristic quantity of the current frame is used for mode discrimination. The pitch prediction gain G is used as the characteristic quantity in the present embodiment. The following formulas are used in the calculation of the pitch prediction gain:

$$G=10\log_{10}[P/E] \quad (29)$$

$$P=\Sigma^{N-1}x_w(n)^2 \quad (30)$$

$$E=P-[\Sigma^{N-1}x_w(n)x_w(n-T)]^2/[\Sigma^{N-1}x_w(n-T)^2] \quad (31)$$

Here, T is the optimum lag that maximizes the pitch prediction gain G.

Pitch prediction gain G is compared with a plurality of predetermined threshold values and classified into a plurality of modes. The number of the modes can be, for example, four.

The mode discrimination circuit 19 provides mode discrimination information to the adaptive codebook circuit 10.

The structure of the adaptive codebook circuit 10 in this embodiment is shown in FIG. 10. The adaptive codebook circuit of this embodiment differs from the adaptive codebook circuit of FIG. 8 in that connection of switches $\mathbf{180}_1$ and $\mathbf{180}_2$ is controlled by mode discrimination information supplied from the mode discrimination circuit 19 (cf. FIG. 9). In this way, switches $\mathbf{180}_1$ and $\mathbf{180}_2$ switch between "lag prediction" and "no lag prediction" according to the mode discrimination information.

The mode discrimination information also controls the operation of the pitch predictor 160, so that the adaptive codebook circuit shown in FIG. 10 may be left unused only when the mode discrimination information indicates predetermined modes (for example, mode 0). In such a case, operation of equation (27) by means of the pitch predictor 160 may be carried out by setting gain β to equal 0.

Figure 11:
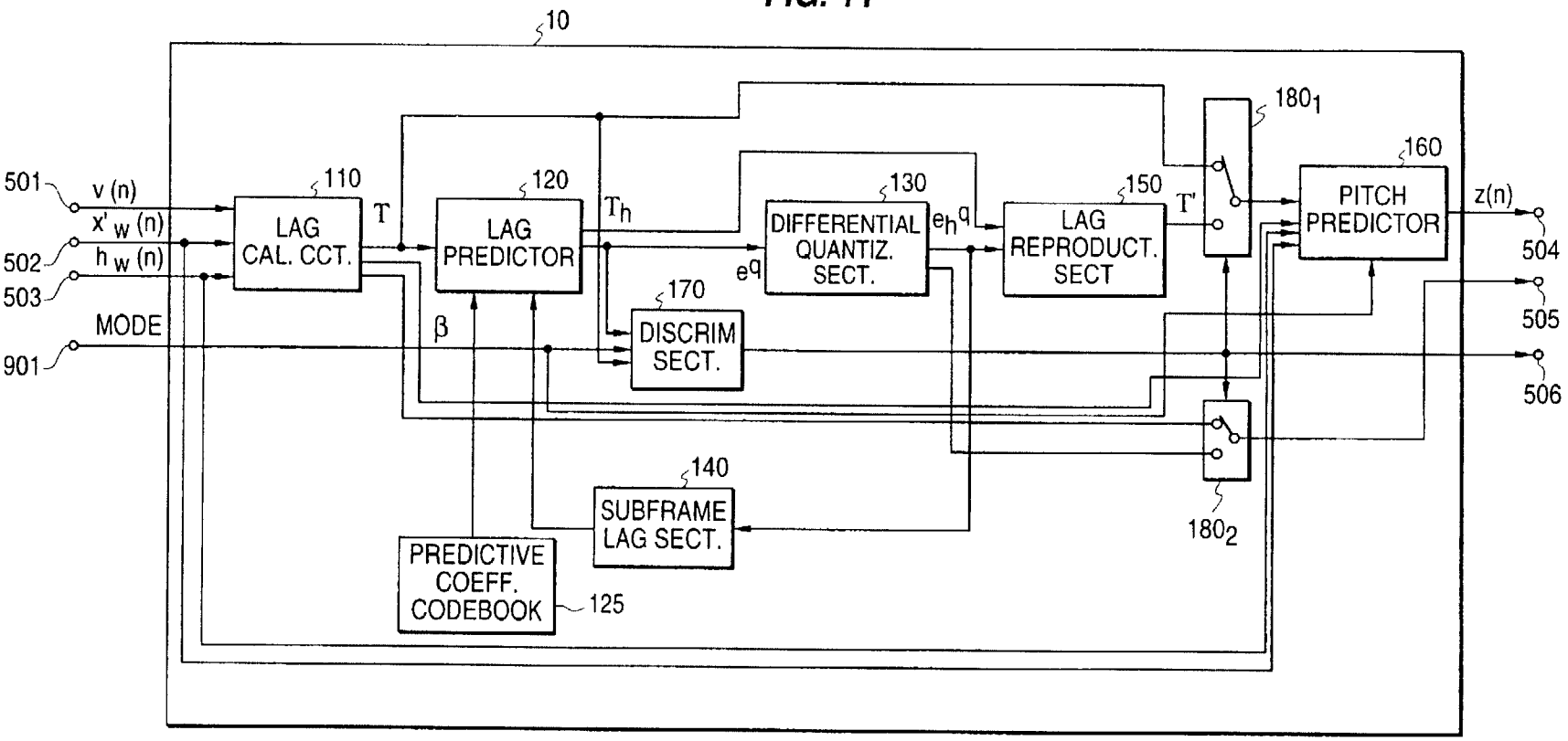
FIG. 11 is a block diagram showing the structure of the adaptive codebook circuit of the sixth embodiment of the present invention.

FIG. 11 is a block diagram showing the adaptive codebook circuit of the sixth embodiment of the speech coding device of the present invention. The adaptive codebook circuit of this embodiment is supplied with mode discrimination information from the mode discrimination circuit 19 of FIG. 9 by way of terminal 901 and supplies the information to a discrimination section 170. The discrimination section 170 discriminates predictive residual $e^q$ with respect to predetermined modes and provides to switches $\mathbf{180}_1$ and $\mathbf{180}_2$ a discrimination signal which indicates prediction or no prediction. No prediction is set for modes other than predetermined modes.

The above-described embodiment allows a variety of modifications.

In the lag predictor 120 of the adaptive codebook circuit, a higher-order prediction scheme may be employed in which lag is predicted from quantized differentials of a plurality of previous frames. Let the order of prediction be L, then the following equation is used as the prediction equation:

$$T_h=\Sigma^L \eta_i e_h^{q-i}, \tag{32}$$

wherein $\Sigma^L$ stands for a sum from i=1 to i=L.

It is also possible that the predictive coefficient codebook may be switched for every mode.

As the structure of the excitation codebook of the excitation quantization circuit, another well-known structure such as multilevel structure or a sparse structure may be used.

A structure may also be employed in which the excitation codebook in the excitation quantization circuit is switched under control of mode discrimination information.

In the excitation quantization circuit, a case has been described in which an excitation codebook is searched, but it is also possible to search a plurality of multipulses having differing positions and amplitudes. In this case, the amplitude and position of the multipulse is set so as to minimize the following equation:

$$D=\Sigma^{N-1}[x_w(n)-\Sigma^k g_j h_w(n-m_j)]^2 \tag{33}$$

Here, $\Sigma^{N-1}$ stands for the sum from n=0 to n=N−1, $\Sigma^k$ for j=1 to j=k, and $g_j$ and $m_j$ indicate the amplitude and position, respectively, of a $j^{th}$ multipulse, and k is the number of multipulses.

Figure 12:
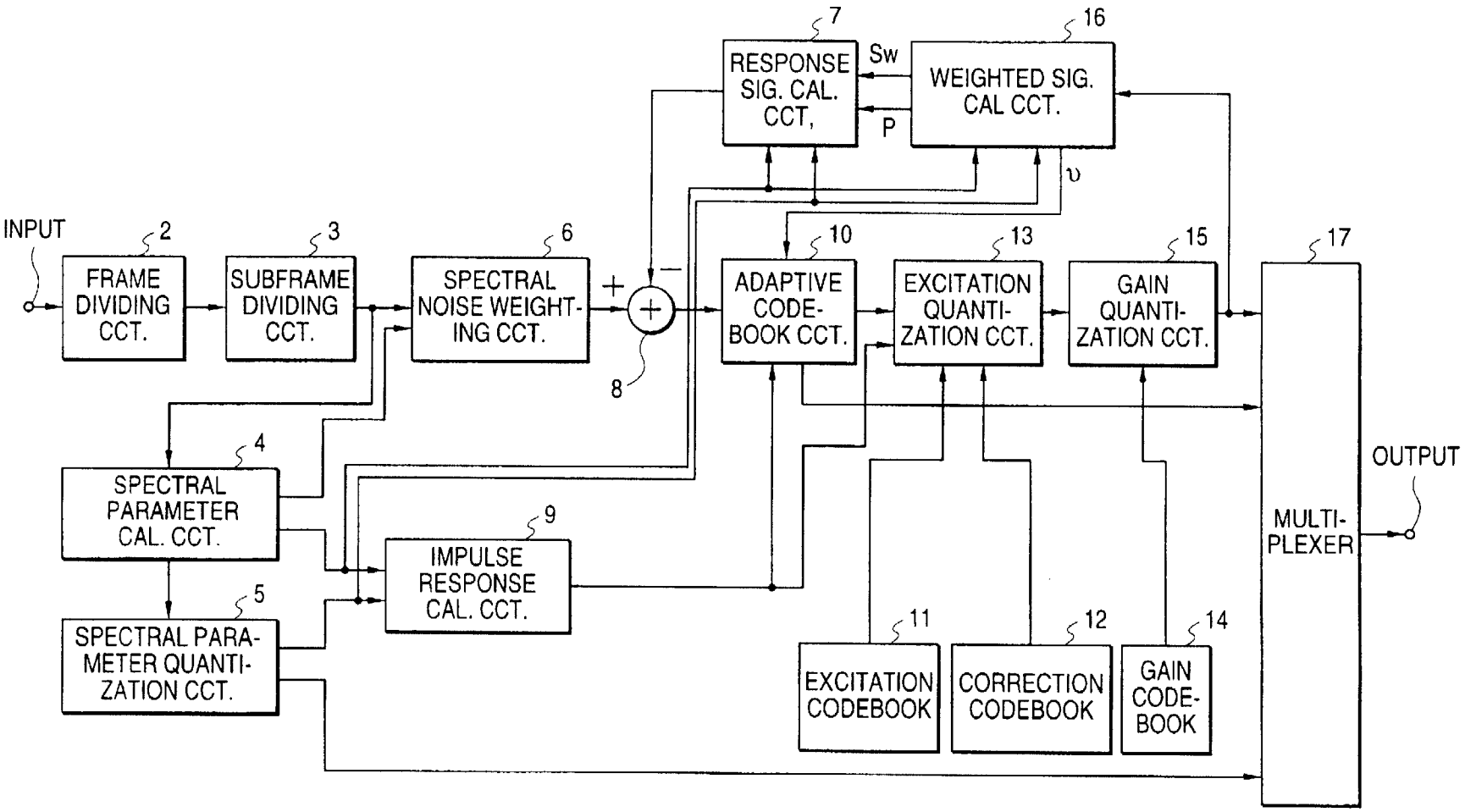
FIG. 12 is a block diagram of the seventh embodiment of the present invention.

FIG. 12 is a block diagram of the seventh embodiment of the speech coding device of the present invention. The device of the present embodiment differs from the device of FIG. 1 in that it is provided with a correction codebook 12. The excitation quantization circuit 13 reads out correction values from the correction codebook 12 for all or a portion of excitation codevectors stored in the excitation codebook 11, and, when searching the excitation codebook, uses equation (10) or equation (11), which take the correction value into consideration, to select an optimum excitation codevector $c_j(n)$ such that equation (2) above is a minimum.

Here, a single optimum excitation codevector $c_j$ may be selected, or two or more codevectors may be first selected and a final selection of a single codebook may be made at the time of gain quantization. In the present embodiment, two or more codevectors are selected. Here, a correction value $\Delta_j$ or $\Delta'_j$ is calculated in advance for a prescribed excitation codevector $c_j(n)$ and stored in correction codebook 12.

The gain quantization circuit 15 reads gain codevectors from the gain codebook 14 and, for the selected excitation codevector $c_j$, selects a combination of the excitation codevector and a gain codevector such that equation (18) is a minimum.

Figure 13:
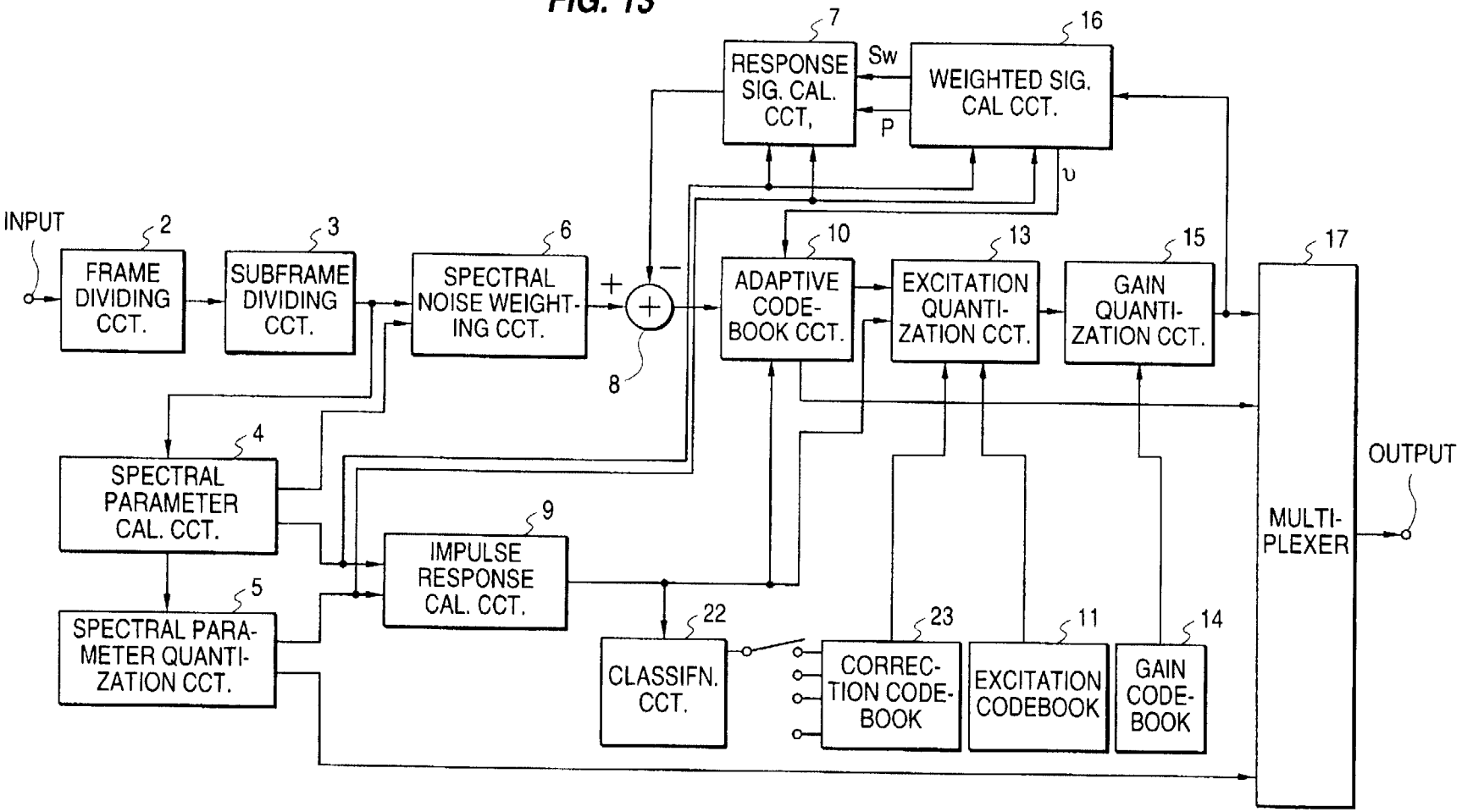
FIG. 13 is a block diagram of the eighth embodiment of the present invention.

FIG. 13 is a block diagram showing the eighth embodiment of the speech coding device of the present invention.

The speech coding device of this embodiment is provided with a classification circuit 22 in addition to the speech coding device of the seventh embodiment, and with correction codebook 23 in place of correction codebook 12. The classification circuit 22 assigns a pattern of a sequence {h(0), h(1), h(3) . . . h(L−1)} of impulse response h(n) supplied from the impulse response calculation circuit 9 to one of K types of predetermined patterns $h_m(n)=\{h_m(0), h_m(1), h_m(2) \ldots h_m(L-1)\}$ $(0 \leqq m \leqq K-1)$. In the correction codebook 23, precalculated values$(\Delta_{j0}, \ldots, \Delta_{jK-1})$ of correction $\Delta_{jm}$ for each of K types of impulse response patterns, are stored for at least one prescribed excitation codevector $c_j$, and K types of correction value codebooks are switched in response to the assignment effected by classification circuit 22 and delivered to the excitation quantization circuit 13.

Assignment is performed such that each of the K patterns of impulse response are prepared in advance as codebooks, and a codebook is selected so as to minimize the distance $D_m$ defined according to the following equation (34) between the impulse response h(n) outputted from the impulse response calculation circuit 9 and the patterns $h'_m(n)$ of the each codebook.

$$D_m=\Sigma^{L-1}[h(n)-h'_m(n)]^2 \tag{34}$$

The operation of this embodiment is otherwise identical to that of the seventh embodiment.

Figure 14:
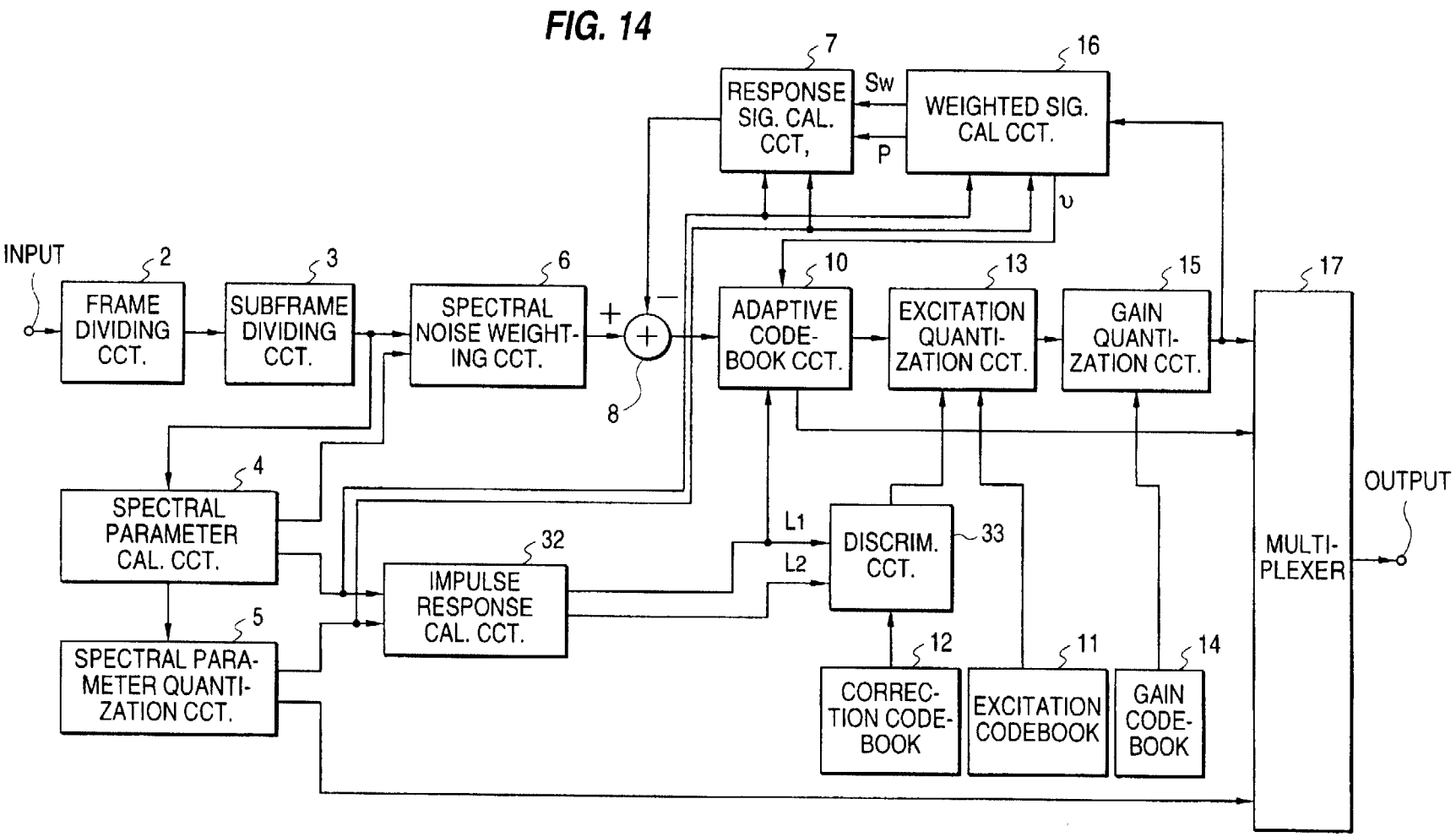
FIG. 14 is a block diagram of the ninth embodiment of the present invention.

FIG. 14 is a block diagram showing the ninth embodiment of the speech coding device of the present invention. The speech coding device according to this embodiment is provided with a discrimination circuit 33 in addition to the speech coding device of seventh embodiment, and is constructed such that an impulse response calculation circuit 32 is provided in place of the impulse response calculation circuit 9 of the seventh embodiment. The impulse response calculation circuit 32 calculates impulse response h(n) to two predetermined orders $L_1$ and $L_2$ $(L_1<L_2)$, and outputs both impulse responses h(n). Of these, the $L_1$ order impulse response h(n) is supplied to the adaptive codebook circuit 10 and the impulse responses h(n) of order $L_1$, $L_2$ are applied to the discrimination circuit 33. The discrimination circuit 33 receives the two impulse responses h(n) of order $L_1$ and $L_2$, compares the correction value Δ read by excitation quantization circuit 13 from the correction codebook 12 with an established threshold value Th, and if the condition $$\Delta > Th \tag{35}$$

is met, then the approximation error according to the autocorrelation method is judged to be large, and the impulse response of order $L_2$ is delivered together with that correction value Δ to the excitation quantization circuit 13 in order to lengthen the impulse response. If the condition represented by inequality (35) is not met, the discrimination circuit 33 delivers the impulse response of order $L_1$ together with that correction value $\Delta$ to the excitation quantization circuit 13. The operation is otherwise identical to that of the seventh embodiment.

Figure 15:
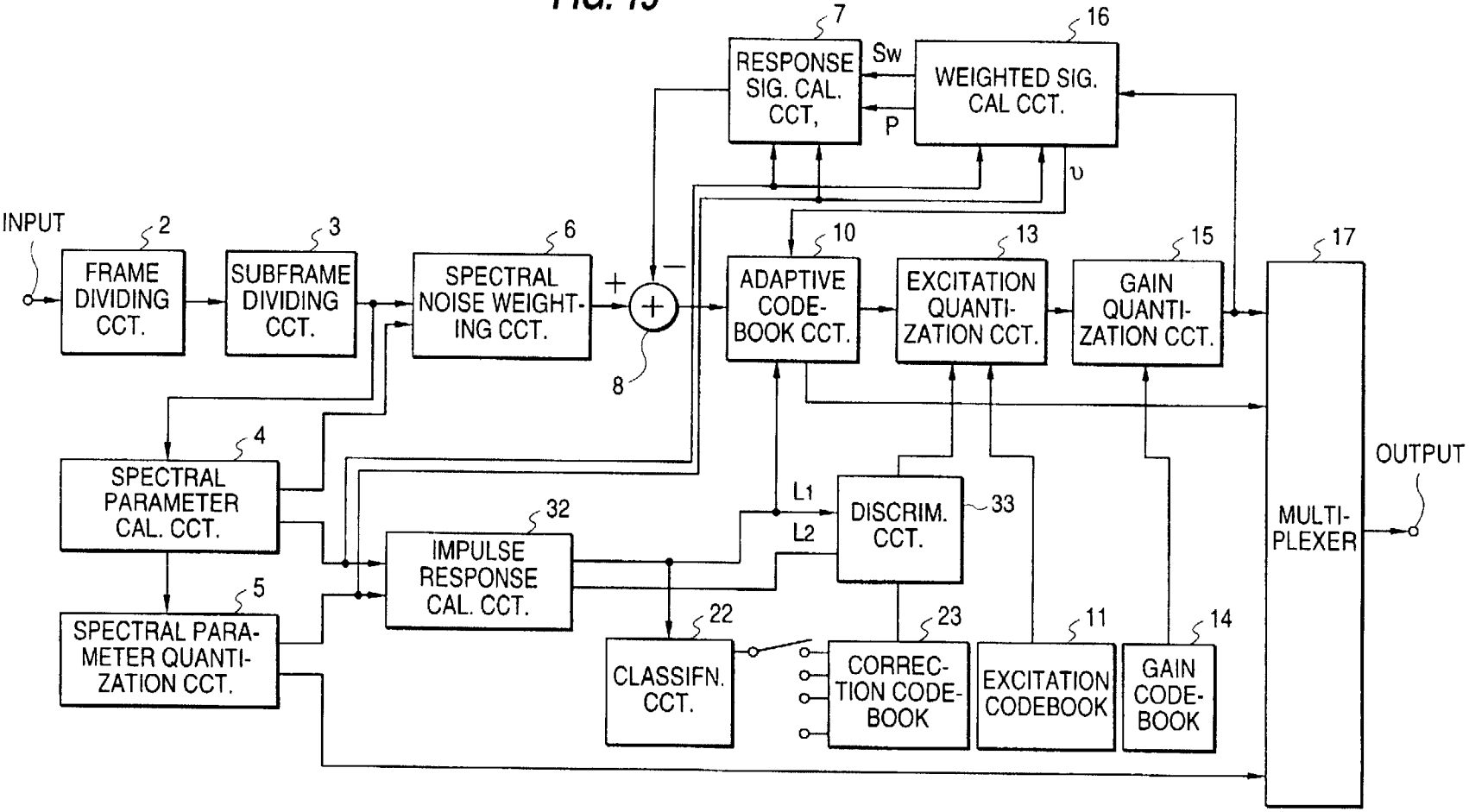
FIG. 15 is a block diagram of the tenth embodiment of the present invention.

FIG. 15 is a block diagram of the tenth embodiment of the speech coding device of the present invention.

The present embodiment is a combination of the eighth and ninth embodiments. The classification circuit 22 receives, of the two impulse responses h(n) of orders $L_1$ and $L_2$ supplied from the impulse response calculation circuit 32, the impulse response h(n) of order $L_1$, attaches this impulse response to one of the K predetermined classes, and delivers the impulse response to the correction codebook 23. The correction codebook 23 switches among the K correction values and outputs the correction value in response to the output of the classification circuit 22. The discrimination circuit 33 reads out at least one correction value from the correction codebook 23, compares the correction value $\Delta$ with precalculated characteristic quantity of speech signal, and as in the ninth embodiment, outputs one of the impulse responses together with the correction value $\Delta$ in accordance with the comparison results to the excitation quantization circuit 13. The operation of the other components is the same as in the seventh embodiment.

Explanation has been presented hereinabove for the seventh to ninth embodiments. A variety of modifications other than the above-described embodiments are also possible without diverging from the spirit of the present invention upon which these embodiments are based.

For example, regarding the above-described formulas (10) and (11), while the search program is constituted such that correction by addition of the correction value $\Delta$ is made when searching the excitation codebook, the program may also be structured such that correction by multiplication of a correction factor is made, or another construction may also be adopted.

In the classification circuit of the eighth and tenth embodiments, the correction term $\Delta_j$ for the excitation codevector $c_j$ is classified using impulse responses. The speech coding method and device, however, may be structured such that classification is performed using spectral parameters, and it is further possible to structure the speech coding method and device such that the correction term is classified using other parameters.

In the discrimination circuit of the ninth and tenth embodiments, the correction value is used as a characteristic quantity, but another quantity, such as both the impulse response and the correction value may also be used.

The gain quantization circuit of the seventh to tenth embodiments may also prelearn a codebook several times larger than the number of bits to be transmitted, assign one section of the area of this codebook as the use area for each predetermined mode, and use the codebook by switching between use areas according to mode when encoding is effected.

The present invention may be summarized as follows:

1) When calculating lag in an adaptive codebook circuit, the position and number of bits of subframes in which lag is expressed by differentials and subframes in which lag is expressed by absolute values is determined for each frame, and therefore, the information transmitted from the adaptive codebook circuit can be reduced compared to the methods of the prior art. Accordingly, the present invention not only enables reduction of bit rate, but provides speech reproduction with little degradation even when a lag corresponding to a pitch period changes abruptly over time for example at a transient portion of a voice.

In the present invention, since speech in a frame is classified into a plurality of modes and since the positions and bit numbers of the subframes in which speech signals are represented by differentials are determined according to the mode, the amount of information allocated to the adaptive codebook for transmission can be decreased as compared with methods of the prior art. As a result, the present invention has the effects of not only allowing a reduction of bit rate, but providing speech reproduction with little degradation even when a lag changes over time corresponding to a pitch cycle at a transient portion of a speech signal.

Finally, according to the present invention, because the adaptive codebook circuit includes processing steps, preferable as described in claims 3, 6, and 7, relatively small amounts of operations and memory are required, and the adaptive codebook section is suitable for installation in, for example, a microcomputer.

For these reasons, the present invention provides a speech coding device that reduces the amount of transmission information and that can obtain excellent sound quality at a low bit rate.

2) According to the speech coding device of the present invention, the number of bits required for expressing a lag can be reduced from, for example, eight to the order of five bits per subframe by predicting the lag using quantized differentials of previous values. Expressed in terms of the amount of lag transmission per second, this corresponds to a reduction from 1.6 kbits/sec to 1 kbits/sec. As a result, the invention has the effects of allowing easy reduction of overall speech coding speed to 4 kbits/sec or less, and providing sound quality superior to the prior art even at reduced coding speeds.

3) According to the present invention, when searching the excitation codebook, it is possible to minimize the approximation errors arising when using an accelerated excitation search method, and to provide speech reproduction having little degradation, by searching a codevector while correcting with a correction value that has been calculated in advance and stored in a correction codebook for at least one excitation codevector. In addition, by classifying impulse response into a plurality of patterns, determining different correction values for each pattern, and switching the correction values according to the impulse response pattern, the present invention can provide a speech reproduction of still higher precision. Furthermore, by calculating the correction value in advance for at least one excitation codevector and changing the order of the impulse response that is taken into account in the calculation of excitation search when this correction value meets predetermined conditions when searching an excitation codevector, sound reproduction of high accuracy can be provided. In this way, the present invention can provide speech reproduction of excellent sound quality with a relatively little amount of operation, with a small capacity of a memory, and at a bit rate of 4.8 kbits/sec or less.

It is to be understood, however, that although the characteristics and advantages of the present invention have been set forth in the foregoing description, the disclosure is illustrative only, and changes may be made in the arrangement of the parts within the scope of the appended claims.

What is claimed is:

1. A speech coding method comprising the steps of:

a first step for dividing a speech signal into frames, and dividing every frame into a plurality of subframes;

a second step for determining, for every frame, subframes in which a lag corresponding to a pitch period of the speech signal in each subframe is expressed as the differential with respect to the lag of the speech signal in a previous subframe, and subframes in which the lag is expressed as the lag value itself, i.e., an absolute value, and allocating, for each of said plurality of subframes, a number of bits for representing the lag;

a third step for calculating, for each subframe, the lag of the speech signal.

2. A method according to claim 1 wherein the second step includes a step for establishing at least one bit number allocation pattern that describes a number of bits allocated to each of the subframes for expressing the lag and the position of the subframe within the frame.

3. A method according to claim 2 wherein said third step for calculating the lag comprises steps of:

(a) reading the bit number allocation pattern;

(b) setting lag search ranges based on a number of bits allocated for each subframe;

(c) calculating pitch prediction distortion for a plurality of lag values within said lag search range for each subframe, extracting at least one pitch prediction distortion in order from the smallest pitch prediction distortion, and searching a lag codebook for a lag corresponding to said at least one pitch prediction distortion;

(d) calculating accumulated distortion, which is an accumulation of said pitch prediction distortion over a predetermined plurality of subframes within the frame concerned;

(e) repeating processes (b) through (d) above for each of the bit number allocation patterns; and (f) selecting the bit number allocation pattern having the smallest accumulated distortion and determining the lag in each of the subframes of that selected pattern as the lag of the speech signal in said each of the subframes.

4. A method according to claim 3 wherein lag search is executed through a closed-loop search using the lag calculated in step (f) as a lag candidate.

5. A method according to claim 1 wherein the second step comprises steps of:

calculating a predetermined characteristic quantity from a speech signal of each frame;

comparing said characteristic quantity with at least one reference value and, depending on whether the characteristic quantity is larger or smaller than the reference value, assigning the speech signal to one of a plurality of defined speech modes;

determining, in dependence on the assigned speech mode, at least one bit number allocation pattern that describes a number of bits allocated to each of the subframes for expressing the lag and the position of the subframe within the frame.

6. A method according to claim 5 wherein said third step of calculating the lag comprises steps of:

(a) setting a lag search range for each subframe based on the allocated number of bits;

(b) for each subframe, calculating pitch prediction distortion for a plurality of lag values in said lag search range, extracting at least one pitch prediction distortion in order from a smallest pitch prediction distortion, and searching the lag corresponding to the extracted pitch prediction distortion from a lag codebook;

(c) calculating an accumulated distortion, which is an accumulation of said pitch prediction distortion over a predetermined plurality of the subframes;

(d) repeating steps (a) through (c) above for each of the bit number allocation patterns belonging to that speech mode;

(e) selecting a bit number allocation pattern which minimizes the accumulated distortion, and determining a lag in each of the subframe within the frame of that selected pattern as the lag of the speech signal; and (f) executing a lag search through a closed-loop search using the lags calculated in step (e) as lag candidates.

7. A method according to claim 6 wherein the characteristic quantity of a speech signal is accumulated distortion which is calculated by accumulating the pitch prediction distortions over entire subframes of the frame concerned.

8. A speech coding method including a lag prediction process comprising the steps of:

dividing a speech signal into predetermined frames, and dividing a speech signal of one frame into a plurality of subframes;

calculating a predictive lag ($T_h^k$) of a speech signal in a current subframe (k) from a quantized differential ($e_h^{k-1}$) of an immediately preceding subframe;

determining the differential ($T^k-T_h^k$) of the lag ($T^k$) in the current subframe (k) relative to a predictive lag ($T_h^k$) as a predictive residual ($e^k$) of a lag of a speech signal in the current subframe (k);

quantizing the predictive residual ($e^k$) of the lag of the speech signal in the current subframe (k) to determine a quantized predictive residual ($e_h^k$); and reproducing the lag ($T^k$) in the current subframe by adding to the predictive lag ($T_h^k$) the quantized predictive residual ($e_h^k$) of the lag for the current subframe.

9. A method according to claim 8, wherein the lag prediction process is executed when the absolute value of the predictive residual of the lag ($e^k$) is judged to be smaller than a reference value, and is not executed when the absolute value of the predictive residual of the lag is judged to be larger than the reference value.

10. A method according to claim 9, comprising the steps of:

extracting a characteristic quantity of a speech signal in each frame, classifying the speech signal into a plurality of speech modes by comparing a numerical value representing the characteristic quantity of the speech signal with predetermined reference values, and executing the judgment on the absolute value of the predictive residual of the lag ($e^k$) when the speech signal of the current frame falls into a predetermined speech mode.

11. A method according to claim 8, comprising the steps of:

extracting a characteristic quantity of a speech signal in each frame, classifying the speech signal into a plurality of speech modes by comparing a numerical value representing the characteristic quantity of the speech signal with predetermined reference values, and executing the lag prediction process when the speech signal of the current frame falls into a predetermined speech mode.

12. A speech coding method comprising steps of:

receiving a speech signal, dividing said speech signal into frames of predetermined time length, and dividing the speech signal of said frame into a plurality of subframes;

calculating spectral parameters that represent a spectral characteristic of said speech signal;

quantizing the spectral parameter in each subframe using a quantization codebook;

calculating impulse response ($h_w(n)$) of a spectral noise weighting filter using quantized spectral parameters and also spectral parameters before quantization;

generating a spectrally weighted speech signal ($x_w(n)$) by performing spectral noise weighting of the speech signal; in response to reception of said spectrally weighted speech signal, said impulse response, and excited speech sound source signal ($v(n-T)$) one pitch period (T) previously calculated by a known method, calculating a lag (T) corresponding to the pitch period of the speech signal and also calculating adaptive codebook predictive residual signal ($z(n)=x_w(n)-\beta v(n-T)*h_w(n)$), both of said calculations being carried out every subframe;

calculating an optimum excitation codevector that minimizes error power ($D_j=\Sigma^{N-1}[z(n)-\gamma_j c_j(n)*h_w(n)]^2$) between said adaptive codebook predictive residual ($z(n)$) and a speech signal synthesized by an excitation codevector ($c_j(n)$) selected from an excitation codebook; wherein the operation that minimizes said error power is executed by using a known approximation equation ($\Sigma^{N-1}[c_j(n)*h_w(n)]^2\approx\mu_j(0)v_j(0)+2\Sigma^{L}\mu_j(i)v_j(i)$, $L\leqq N$, $\mu_j(i)=\Sigma^{N-1-i}c_j(n)c_j(n+i)$, $v_j(i)=\Sigma^{N-1-i}h_j(n)h_j(n+j)$) by means of a known auto-correlation method, said operation comprising the steps of:

measuring and storing the deviation of the value of this approximation equation from the true value in a correction codebook as a correction value ($\Delta_j$); and calculating said error power by correcting the approximated value obtained by said approximation equation with the correction value.

13. A method according to claim 12 wherein, for each excitation codevector($c_j$), a plurality (K) of patterns of said impulse response are established, correction values ($\Delta_{j1}$, $\Delta_{j2}$, $\Delta_{j3}$ . . . $\Delta_{jK}$) corresponding to the patterns of the impulse response are calculated in advance and stored in a correction codebook, an impulse response calculated from an incoming speech signal is assigned to one of said plurality of patterns, and error power is corrected with the correction value corresponding to the assigned pattern.

14. A method according to claim 13, wherein impulse response ($h_w(n)$) is calculated to two different orders $L_1$ and $L_2$ ($L_1<L_2$), the impulse response of order $L_1$ is classified into one of the established patterns of the impulse response, and the correction value corresponding to said one of the established pattern is used for calculating said error power; and this correction value is compared with a reference value, and according to the comparison result, the impulse response of either order $L_1$ or $L_2$ is used to calculate said error power.

15. A method according to claim 12, wherein the impulse response ($h_w(n)$) is calculated to two different orders $L_1$ and $L_2$ ($L_1<L_2$), the impulse response ($h_w(n)$) of order $L_1$ is used to calculate an adaptive codebook predictive residual signal, and further, the correction value used in calculating said error power for finding said optimum excitation codevector is compared with a reference value, and if the correction value exceeds the reference value, said error power is calculated with the impulse response ($h_w(n)$) of order $L_2$.

16. A speech coding device comprising:

frame splitter means that receives an incoming speech signal, divides said speech signal into frames of a predetermined time length, and splits the speech signal of each of said frames into a plurality of subframes;

spectral parameter calculator means that calculates spectral parameters that represent a spectral characteristic of said speech signal;

spectral parameter quantizer means that quantizes the spectral parameters for each subframe using a quantization codebook;

impulse response calculator means that receives outputs of said spectral parameter calculator means and outputs of said spectral parameter quantizer means and calculates impulse responses of a spectral noise weighting filter;

spectral noise weighting means for executing spectral noise weighting of said speech signal according to the spectral parameter supplied from said spectral parameter calculator means to generate a spectrally weighted speech signal;

adaptive codebook means that receives a spectrally weighted speech signal, said impulse response, and a previous excited speech sound source signal calculated by a known method, calculates a lag corresponding to a pitch period of the speech signal every subframe, and outputs both the calculated result and an adaptive codebook predictive residual signal;

excitation quantizer means that selects an optimum excitation codevector from an excitation codebook such that error power between said adaptive codebook predictive residual signal and a speech signal synthesized from the excitation codevector selected from the excitation codebook minimizes;

gain quantizer means that selects an optimum gain codevector such that error power between said adaptive codebook predictive residual signal and a speech signal synthesized from both said optimum excitation codevector and a gain codevector selected from the gain codebook minimizes;

multiplexer means for multiplexing the parameters extracted from said spectral parameter calculator means and from said adaptive codebook means and indexes indicating the optimum excitation codevector and the optimum gain codevector; and pattern storage means for storing at least one type of bit number allocation pattern that, for every frame, describes locations, within that frame, of subframes for which lags are to be represented by differentials and also describes numbers of bits allocated to the subframes for representing the lags;

said adaptive codebook means (a) reading the bit number allocation pattern from the pattern storage means;

(b) setting lag search ranges based on a number of bits allocated for each subframe;

(c) calculating pitch prediction distortion for a plurality of lag values within said lag search range for each subframe, extracting at least one pitch prediction distortion in order from the smallest pitch prediction distortion, and searching the lag codebook for the lag corresponding to the at least one extracted pitch prediction distortion for each of the subframes;

(d) calculating accumulated distortion, which is an accumulation of said pitch prediction distortion over a predetermined plurality of the subframes within the frame of concern;

(e) repeating processes (b) through (d) above for each of the bit number allocation patterns;

(f) selecting a bit number allocation pattern which minimizes the accumulated distortion and determining a lag of the speech signal for each subframe of that selected pattern as a lag of the speech signal in each of the subframes;

(g) calculating lag by means of a closed loop search using the lags calculated in process (f) as lag candidates, and (h) generating an adaptive codebook predictive residual signal which is the difference between said weighted signal and a weighted signal synthesized from a previous excited speech sound source signal.

17. A speech coding device comprising:

frame splitter means that receives an incoming speech signal, divides said speech signal into frames of a predetermined time length, and splits the speech signal of each of said frames into a plurality of subframes;

spectral parameter calculator means that calculates spectral parameters that represent a spectral characteristic of said speech signal;

spectral parameter quantizer means that quantizes the spectral parameters for each subframe using a quantization codebook;

impulse response calculator means that receives outputs of said spectral parameter calculator means and outputs of said spectral parameter quantizer means and calculates impulse responses of a spectral noise weighting filter;

spectral noise weighting means for executing spectral noise weighting of said speech signal according to the spectral parameter supplied from said spectral parameter calculator means to generate a spectrally weighted speech signal;

adaptive codebook means that receives a spectrally weighted speech signal, said impulse response, and a previous excited speech sound source signal calculated by a known method, calculates a lag corresponding to a pitch period of the speech signal every subframe, and outputs both the calculated result and an adaptive codebook predictive residual signal;

excitation quantizer means that selects an optimum excitation codevector from an excitation codebook such that error power between said adaptive codebook predictive residual signal and a speech signal synthesized from the excitation codevector selected from the excitation codebook minimizes;

gain quantizer means that selects an optimum gain codevector such that error power between said adaptive codebook predictive residual signal and a speech signal synthesized from both said optimum excitation codevector and a gain codevector selected from the gain codebook minimizes;

multiplexer means for multiplexing the parameters extracted from said spectral parameter calculator means and from said adaptive codebook means, and indexes indicating the optimum excitation codevector and the optimum gain codevector; and mode classification means that receives the output of said frame splitter means, calculates a characteristic quantity from the speech signal in each frame, and classifies the speech signal of each frame into one of a plurality of predetermined speech modes in accordance with the characteristic quantity;

said adaptive codebook means receiving the output of said mode classification means and:

(a) determining at least one bit number allocation pattern that describes a number of bits allocated to each of the subframes for expressing the lag and the position of the subframe within the frame;

(b) setting lag search ranges based on a number of bits allocated to each subframe;

(c) calculating pitch prediction distortion for a plurality of lag values within said lag search range for each subframe, extracting at least one pitch prediction distortion in order from the smallest pitch prediction distortion, and searching the lag codebook for the lag corresponding to the at least one extracted pitch prediction distortion for each of the subframes;

(d) calculating accumulated distortion, which is an accumulation of said pitch prediction distortion over a predetermined plurality of the subframes within the frame of concern;

(e) repeating processes (b) through (d) above for each of the bit number allocation patterns;

(f) selecting a bit number allocation pattern which minimizes the accumulated distortion and determining a lag of the speech signal for each subframe of that selected pattern as a lag of the speech signal in each of the subframes; and (g) calculating lag by means of a closed loop search using the lags calculated in process (f) as lag candidates.

18. A speech coding device comprising:

frame splitter means that receives an incoming speech signal, divides said speech signal into frames of a predetermined time length, and splits the speech signal of each of said frames into a plurality of subframes;

spectral parameter calculator means that calculates spectral parameters that represent a spectral characteristic of said speech signal;

spectral parameter quantizer means that quantizes the spectral parameter for each subframe using a quantization codebook;

impulse response calculator means that receives outputs of said spectral parameter calculator means and outputs of said spectral parameter quantizer means and calculates impulse responses of a spectral noise weighting filter;

spectral noise weighting means for executing spectral noise weighting of said speech signal according to the spectral parameter supplied from said spectral parameter calculator means to generate a spectrally weighted speech signal;

adaptive codebook means that receives a spectrally weighted speech signal, said impulse response, and a previous excited speech sound source signal calculated by a known method, calculates a lag corresponding to a pitch period of the speech signal every subframe, and outputs both the calculated result and an adaptive codebook predictive residual signal;

excitation quantizer means that selects an optimum excitation codevector from an excitation codebook such that error power between said adaptive codebook predictive residual signal and a speech signal synthesized from the excitation codevector selected from the excitation codebook minimizes;

gain quantizer means that selects an optimum gain codevector such that error power between said adaptive codebook predictive residual signal and a speech signal synthesized from both said optimum excitation codevector and a gain codevector selected from the gain codebook minimizes;

multiplexer means for multiplexing the parameters extracted from said spectral parameter calculator means and from said adaptive codebook means, and indexes indicating the optimum excitation codevector and the optimum gain codevector;

said adaptive codebook means comprising:

a lag calculator that receives a spectrally weighted speech signal ($x_w(n)$), said impulse response ($h_w(n)$) and an excited speech sound source signal ($v(n-T)$) one pitch period previous according to a known method, calculates a lag ($T^k$) of a current subframe (k), and further, calculates a gain ($\beta$) of a predicted value of an autocorrelation coefficient for the predicted power of a speech signal;

a subframe delay section that receives quantized lag predictive residuals ($e_h^k$) of the present subframe (k) and outputs a lag predictive residual ($e_h^{k-1}$) of an immediately preceding subframe (k−1);

a lag predictor that receives the prediction coefficient codebook and, from the subframe delay section, the lag predictive residuals ($e_h^{k-1}$) for the immediately preceding subframe, reads a prediction coefficient ($\eta$) from the prediction coefficient codebook and calculates a predictive lag ($T_h=\eta e_h^{k-1}$), and further, generates lag predictive residuals ($e^k=T^k-T_h$) of the current subframe;

a differential quantizer that is supplied with a lag predictive residual ($e^k$) of the current subframe and outputs a quantized lag predictive residual ($e_h^k$);

a lag reproduction section that is supplied with both a predictive lag ($T_h$) from said lag predictor and a quantized lag predictive residual ($e_h^k$) from said differential quantizer and reproduces a lag ($T'^k$); and a pitch predictor that is supplied with a spectrally weighted speech signal ($x_w(n)$), said impulse response ($h_w(n)$), and an excited speech sound source signal ($v(n-T)$) one pitch period previous calculated according to a known method, further supplied with a gain ($\beta$) from said lag calculator, also supplied with reproduced lag ($T'^k$) from said lag reproduction section, and calculates an adaptive codebook predictive residual signal ($z(n)=x_w(n)-\beta v(n-T'^k)*h_w(n)$).

19. A device according to claim 18 wherein said adaptive codebook means further comprises: a discrimination section that further calculates the lag predictive residual ($e^k$), and outputs a first predictive discrimination signal when the absolute value of said lag predictive residual is judged to be smaller than a reference value, and outputs a second predictive discrimination signal when the absolute value of said residual is judged to be larger than the reference value; and a switch section that, under the control of said first predictive discrimination signal, connects the reproduced lag ($T'^k$) to said pitch predictor, and, under the control of said second predictive discrimination signal, connects the lag ($T^k$) of said current subframe to said pitch predictor.

20. A device according to claim 19, further comprising a mode discrimination section that extracts a characteristic quantity of a speech signal in every frame, compares a numerical value that represents said characteristic quantity with a reference value and classifies the speech signal into one of a plurality of predetermined speech modes, and provides a mode discrimination signal corresponding to each speech mode; and said discrimination section of said adaptive codebook means executes discrimination of the lag predictive residual ($e^k$) when the mode discrimination signal belongs to a prescribed speech mode.

21. A device according to claim 18, further comprising a mode discrimination section that extracts a characteristic quantity of the speech signal in each frame, compares a numerical value that represents this characteristic quantity with a reference value, classifies the speech signal into one of a plurality of predetermined speech modes, and provides a mode discrimination signal corresponding to each speech mode, wherein said adaptive codebook means includes a switch section that connects the reproduced lag ($T'^k$) to said pitch predictor when the mode discrimination signal belongs to a prescribed speech mode.

22. A speech coding device comprising:

frame splitter means that receives an incoming speech signal, divides said speech signal into frames of a predetermined time length, and splits the speech signal of each of said frames into a plurality of subframes;

spectral parameter calculator means that calculates spectral parameters that represent a spectral characteristic of said speech signal;

spectral parameter quantizer means that quantizes the spectral parameter for each subframe using a quantization codebook;

impulse response calculator means that receives outputs of said spectral parameter calculator means and outputs of said spectral parameter quantizer means and calculates impulse responses of a spectral noise weighting filter;

spectral noise weighting means for executing spectral noise weighting of said speech signal according to the spectral parameter supplied from said spectral parameter calculator means to generate a spectrally weighted speech signal;

adaptive codebook means that receives a spectrally weighted speech signal, said impulse response, and a previous excited speech sound source signal calculated by a known method, calculates a lag corresponding to a pitch period of the speech signal every subframe, and outputs both the calculated result and an adaptive codebook predictive residual signal;

excitation quantizer means that, using an approximation equation, selects an optimum excitation codevector that minimizes error power between said adaptive codebook predictive residual signal and a speech signal synthesized from an excitation codevector selected from an excitation codebook; and a correction codebook that stores, as correction values, values of deviation from true values, produced by said approximation equation when said excitation quantizer means operates using a known approximation equation to minimize said error power, wherein the values of the deviation are calculated in advance.

23. A device according to claim 22 wherein a plurality (K) of patterns of series of said impulse responses are established for each excitation codevector ($c_j$); the device further comprising classification means for classifying a series of impulse responses calculated from incoming speech signals into one of said plurality of patterns, and said correction codebook storing correction values ($\Delta_{j1}, \Delta_{j2}, \Delta_{j3} \ldots \Delta_{jK}$) calculated in advance corresponding to said patterns; and wherein said excitation quantizer means corrects error power using correction values corresponding to these classified patterns.

24. A device according to claim 23 wherein said impulse response calculator means calculates series of impulse responses to two orders, $L_1$ and $L_2$ ($L_1<L_2$), and the series of impulse responses of order $L_1$ is supplied to said adaptive codebook means; the speech coding device further comprising discrimination means that compares the correction value ($\Delta_{jK}$)corresponding to the classified pattern with a reference value, and according to the result of comparison, supplies the series of impulse responses of either order $L_1$ or $L_2$ to the excitation quantizer means together with the correction value.

25. A device according to claim 22 wherein said impulse response calculator means calculates impulse responses to two orders, $L_1$ and $L_2$ ($L_1<L_2$), and the impulse responses of order $L_1$ are supplied to said adaptive codebook means; the speech coding device further comprising discrimination means that compares the correction value with a reference value, and according to the comparison result, supplies impulse responses of either order $L_1$ or order $L_2$ to said excitation quantizer means.

* * * * *